United States Patent [19]

Frankfort et al.

[11] 4,195,051

[45] Mar. 25, 1980

[54] PROCESS FOR PREPARING NEW POLYESTER FILAMENTS

[75] Inventors: Hans R. E. Frankfort; Benjamin H. Knox, both of Kinston, N.C.

[73] Assignee: E. I. Du Pont de Nemours and Company, Wilmington, Del.

[21] Appl. No.: 948,802

[22] Filed: Oct. 5, 1978

Related U.S. Application Data

[60] Division of Ser. No. 802,977, Jun. 2, 1977, Pat. No. 4,134,882, which is a continuation-in-part of Ser. No. 694,919, Jun. 11, 1976, abandoned.

[51] Int. Cl.[2] ..... B28B 3/20; D01D 5/12; D01F 11/00

[52] U.S. Cl. ..... 264/176 F; 264/210.2

[58] Field of Search ..... 264/176 F, 210 F

[56] References Cited

U.S. PATENT DOCUMENTS

| | | | |
|---|---|---|---|
| 2,604,667 | 7/1952 | Hebeler | 264/168 |
| 3,216,187 | 11/1965 | Chantry et al. | 264/346 X |
| 3,707,593 | 12/1972 | Fukada et al. | 264/210 F |
| 3,739,056 | 6/1973 | Evans et al. | 264/290 T |
| 3,772,872 | 11/1973 | Piazza et al. | 264/210 F |
| 3,789,031 | 1/1974 | Buttner et al. | 528/309 |
| 3,963,678 | 6/1976 | Conrad et al. | 528/273 |
| 4,025,592 | 5/1977 | Bosley et al. | 264/78 |

*Primary Examiner*—Lucille M. Phynes

[57] ABSTRACT

Poly(ethylene terephthalate) filaments of enhanced dyeability, low boil-off shrinkage (even in as-spun condition), good thermal stability over a large temperature range; and useful as texturing feed yarns and/or as hard yarns requiring no further drawing are prepared by spinning at extremely high speeds, and are characterized by a long period spacing above 300 Å in their as-spun condition, and, whether in as-spun condition or after heat-treatment, by a low skin-core value as measured by a differential birefringence in relation to their stress measured at 20% extension (which correlates approximately with the spinning speed), a large crystal size, and low amorphous orientation. The continuous filament yarns may be draw-textured to provide textured yarns which also show enhanced dyeability. The staple fiber yarns also have very useful properties as compared with conventional staple yarns. A preferred process of spinning at these extremely high speeds is characterized by the use of a spinneret with capillary-dimensions that produce high shear as the polyester is extruded, and is applicable also to copolyesters, whose filaments show a similar low skin-core in relation to their stress at 20% extension, the precise values for copolymers being different from the relationship for poly(ethylene terephthalate).

26 Claims, 3 Drawing Figures

PROCESS FOR PREPARING NEW POLYESTER FILAMENTS

CROSS-REFERENCE TO RELATED APPLICATION

This application is a division of application Ser. No. 802,977, now U.S. Pat. No. 4,134,882, filed June 2, 1977, which is itself a continuation-in-part of application Ser. No. 694,919, filed June 11, 1976, now abandoned.

BACKGROUND OF THE INVENTION

This invention concerns improvements in and relating to synthetic linear polyester filaments, and more particularly to the dyeability, thermal stability and texturability of such filaments, and to processes for the production of such filaments.

Polyester filaments have been prepared commercially for more than 25 years, and are now manufactured in large quantities amounting to billions of pounds annually. Most of this commercial manufacture has been of poly (ethylene terephthalates). These commercial polyester filaments have been difficult to dye, e.g. as mentioned by H. Ludewig in Section 11.4 "Dyeing Properties" of his book "Polyester Fibers, Chemistry and Technology", German Edition 1964 by Akademie-Verlag and English translation 1971 by John Wiley and Sons Limited. Special dyeing techniques have therefore been used commercially, e.g. dye bath additives called "carriers" have been used to dye the homopolymer, usually at higher pressures and temperatures, or the chemical nature of the polyester has been modified to increase the rate of dyeing or to introduce dye-receptive groups, e.g. as discussed in Griffing & Remington U.S. Pat. No. 3,018,272. These special techniques involve considerable expense, and it has long been desired to provide polyester filaments having useful physical properties, e.g. for apparel and home furnishing applications, but having a dyeability more like that of natural fibers, such as cotton, or cellulosic fibers, such as viscose rayon, which can be dyed at the boil within a reasonable period of time without the need for special techniques of the type referred to. Any reduction in the amount of carrier used is desirable for ecologic as well as economic reasons. Although there have been many suggestions for solving this longstanding problem, it has still been necessary, in commercial practice, to use special dyeing techniques or to introduce chemical modification, as indicated above.

For most consumer purposes, polyester filaments should have good thermal stability, i.e. relatively low shrinkage and preferably over a large temperature range. The maximum permissible shrinkage may vary depending on the intended use, but a boil-off shrinkage of less than about 2% in the final fabric has become generally accepted as necessary for consumer applications. Hitherto, commercial polyester yarns have been prepared with considerably higher boil-off shrinkage, e.g. 8 to 10%, so it has been customary to prepare fabrics with these yarns and then reduce the boil-off shrinkage by heat-setting the fabric. Any new polyester yarns should have a boil-off shrinkage no higher than is customary. It would also be advantageous to be able to prepare continuous filaments having the desired low boil-off shrinkage directly, i.e. by spinning such filaments without any need for further treatment such as heat-setting. A low shrinkage at higher temperatures (120°-200° C.), such as are usually encountered during textile finishing and pressing operations, i.e. a low dry heat shrinkage, would also be desirable. Hitherto, most commercial polyester filaments have had a dry heat shrinkage significantly more than their boil-off shrinkage. It has long been desired to provide a polyester yarn with good thermal stability when subjected to either boil-off or such dry heat at higher temperatures.

Thus, it would have been very desirable to provide poly(ethylene terephthalate) filaments with a combination of good thermal stability and good dyeing properties. Such a combination has not been commercially available heretofore.

A large amount of polyester yarn is subjected to a texturing process to increase its bulk. False-twist texturing has generally been the preferred process. Texturability of a polyester yarn is an important requirement, therefore, in the sense that it is required that the polyester yarn be texturable on a commercial false-twist texturing machine without producing a large number of yarn defects, such as broken filaments, or lack of dye uniformity, which may become manifest only in the final fabric.

For many years polyester filaments were melt spun and wound onto a package without drawing at speeds of up to about 1000 meters/minute, e.g. as described in Chapter 5 of Ludewig. This process (which can now be termed "low speed spinning") provided filaments of relatively low orientation (as measured by a low birefringence), relatively low tenacity, low yield-point and relatively high break-elongation. These filaments were not useful as textile yarns until they had been subjected to a drawing process. Thus it was originally standard procedure first to make a package of spun polyester filament and then to subject the filament to a drawing and annealing process which increased tenacity, yield point, orientation (birefringence) and crystallinity, and reduced break-elongation, thus producing "hard" filaments which could be used commercially.

This procedure was referred to as the "split process" and was expensive, primarily because of the need to operate the stages of the process at different speeds, and therefore, to wind up filaments at each intermediate stage. It has long been desirable to produce hard filaments continuously, i.e. to reduce the number of separate stages involved in hard filament production and thus avoid the need for winding up after any intermediate processes.

For instance, the processes of melt spinning and drawing have been combined into a coupled spin-drawing process without intermediate windup, e.g. as disclosed in Example IV of Cantry & Molini U.S. Pat. No. 3,216,187, wherein the polyethylene terephthalate was melt spun at a (low) withdrawal speed of 500 yards/minute (450 meters/minute), and drawn immediately (i.e. without intermediate windup) 6×and annealed before windup at 3000 yards/minute (2700 meters/minute). Coupled spin-drawing produces a drawn yarn of high tenacity, crystallinity, orientation, yield point and reduced break-elongation, i.e. a hard yarn, comparable to drawn yarn produced by low speed spinning and drawing in separate process-stages, i.e. the split process.

In recent years, polyester filaments have been manufactured by a process of "high speed spinning". This typically involves the use of windups operating at speeds, e.g., of 3000 to 4000 meters/minute, similar to those in the coupled spin-drawing process, but is a one-step process in which the polyester filaments are spun and wound directly at a high withdrawal speed, without any drawing step. High speed spinning has been used to produce partially oriented yarns that are particularly useful for draw-texturing, as disclosed by Petrille in U.S. Pat. No. 3,771,307, and this process is now operated commercially on a large scale. The partially oriented yarn that has been produced by high speed spinning has higher orientation (birefringence) and tenacity, with reduced break-elongation, compared to undrawn yarn produced by low speed spinning. The partially oriented yarn produced by high speed spinning has a lower crystallinity than drawn yarn produced theretofore by either a coupled or a split process. Although high speed spinning of polyester filaments had been patented in July 1952 by Hebeler in U.S. Pat. No. 2,604,689, and received further technical attention, e.g. in Section 5.4.1 in Ludewig, and by Griehl in U.S. Pat. No. 3,053,611, it has only been within the present decade that high speed spinning has been commercially practiced.

Hebeler also described, in U.S. Pat. No. 2,604,667, using still higher withdrawal speeds, in excess of 5200 yards/minute (4700 meters/minute), to produce polyester filaments having tenacities of at least 3 grams/denier and boil-off shrinkages of about 4% or less in the as-spun state. Although this disclosure has been available for more than 20 years, and has been extensively investigated by experts such as Ludewig, it has not been been suggested by such experts that the need for poly (ethylene terephthalate) filaments having the aforesaid combination of properties (enhanced dyeability accompanied by thermal stability over a large temperature range) could have been satisfied by spinning the filaments at extremely high withdrawal speeds.

THE INVENTION

It has now been found that poly(ethylene terephthalate) filaments spun using extremely high withdrawal speeds (e.g. over about 5000 meters/minute) show excellent "dye at the boil capability", i.e. it is possible to dye such filaments at the boil within a reasonable period of time without the need for conventional "carriers" or chemical modifiers mentioned above. Prior commercial poly(ethylene terephthalate) textile yarns, having similar physical properties, e.g. tensile properties and boil-off shrinkage, have not shown this capability. When these dyeable yarns are textured, they may lose some of this capability, to an extent depending on the speed of withdrawal during spinning, but such textured yarns can be dyed with a reduced need for carriers. It has also now been found that polyester filaments that have been spun at these extremely high withdrawal speeds have good thermal stability, i.e. relatively low shrinkage over a large temperature range. Prior commercial polyester textile filaments have not shown such stability. It has also been found that most filaments spun at these extremely high withdrawal speeds are characterized by a high long-period spacing (LPS) of over 300 Å. These properties seem to be largely inherent in filaments spun at withdrawal speeds taught by Hebeler in U.S. Pat. No. 2,604,667. Other useful characteristics have also now been discovered in yarns produced at extremely high speeds, especially above 6000 meters/minute.

Increasingly difficult problems with broken filaments have, however, been encountered as the withdrawal speed has been increased, to the extent that sometimes it has not even been possible to achieve continuity of winding at these extremely high speeds. Broken filaments and other yarn defects have also presented problems during subsequent textile operations, such as texturing, when using filaments spun at these extremely high withdrawal speeds.

It has now been found that many of these problems during spinning at these extremely high speeds, or during subsequent textile operations on the resulting filaments, can be associated with a significant difference between the birefringence of the surface and the birefringence of the core of the filament, and that better filaments can, therefore, be obtained more reliably and consistently by controlling the spinning and cooling conditions so as to minimize such difference in the as-spun filament. We refer to this difference herein as differential birefringence ($\Delta_{95\text{-}5}$), being the difference in birefringence between points along the radius of the filament at the indicated 95 and 5 percentage distances from the axis, or more simply as "skin-core". The skin-core values generally increase with the spinning speed, i.e. the speed of withdrawal from the spinneret, which correlates approximately with the stress required to extend the as-spun yarn by 20% ($\sigma_{20}$). As the spinning speed increases from about 5500 yards/minute (about 5000 meters/minute), it becomes increasingly more difficult to ensure that the skin-core value is low enough to reduce the likelihood of problems, such as broken filaments, to an acceptable level. If the filaments are spun at about 5500 yards/minute (about 5000 meters/minute), problems resulting from high skin-core values may be manifest only during subsequent textile operations, e.g. broken filaments during texturing, or breaks and other defects in, e.g. woven fabrics. As the spinning speed increases, however, high skin-core values in the solidified filaments are more likely to cause continuity problems in the actual spinning process. Problems with continuity in spinning or with yarn and fabric defects can also be caused by other factors, so that it is not a complete solution to such problems merely to arrange for the filaments to be spun with a low skin-core, and to ignore the effect of other factors, but it has now been found that the spinning of filaments having high skin-core values at these extremely high withdrawal speeds will generally cause such problems, despite care in controlling other factors.

There are provided, therefore, according to the invention, low shrinkage poly(ethylene terephthalate) filaments having enhanced dyeability, a long-period spacing (LPS) of more than 300 Å and a differential birefringence ($\Delta_{95\text{-}5}$) as herein defined according to the relationship $$\Delta_{95\text{-}5} \leqq 0.0055 + 0.0014\,\sigma_{20}$$

where $\sigma_{20}$ is the stress measured in grams per denier (gpd) at 20% extension and is at least 1.6 gpd. When $\sigma_{20}$ is between 3 and 4 gpd, however, $\Delta_{95\text{-}5}$ may be $\leqq 0.0065\,\sigma_{20} - 0.0100$. $\Delta_{95\text{-}5}$ is preferably less than 0.008.

When these filaments are annealed, the long-period spacing (LPS) decreases significantly. The filaments are, however, cnaracterized by an amorphous birefringence ($\Delta_{am}$) less than 0.07, and crystal size (CS) of at least (1250 $\rho$- 1670) Å where $\rho$ is the density, which is preferably at least 1.37 g/cm$^3$, whether such filaments are as-spun or annealed. Preferred features of these filaments are that the dyeability be such that the relative disperse dye rate (RDDR defined hereinafter) be at least 0.050, the thermal stability be such that the dry heat shrinkage (DHS) be not more than 1% more than the boil-off shrinkage (BOS), and that the mean birefringence $\Delta_5$ be between 0.09 and 0.14.

The filaments are especially useful in the form of continuous filamentary yarns and continuous filamentary tows. Wound packages comprising at least 60,000 meters, and preferably at least 250,000 meters of such poly(ethylene terephthalate) continuous filamentary yarn having the above properties are provided.

"Hard" as-spun poly(ethylene terephthalate) continuous filament yarns of $\sigma_{20} \geqq 2.6$ gpd having dye-at-the-boil capability, thermal stability and other properties as mentioned herein, and wound packages of such yarns are provided.

Staple fiber having useful properties are also provided, and processes therefor.

There is also provided, in a process for meltspinning ethylene terephthalate polyester filaments with a low differential birefringence between the surface and the core of such filaments, the improvement, when withdrawing the filaments at a speed (V in yards/minute) of at least about 5200 yards/minute (4700 meters/minute), preferably at least about 5500 yards/minute, wherein the polymer temperature ($T_p$), measured (in °C.) in the filter pack at a point 50–100 mils above the center of the spinneret plate, is maintained above a minimum value depending on an exponential of the speed V and a function of the length (L) and diameter (D) (in mils) of the spinneret capillary and the throughput (W) per capillary (in pounds per hour, pph), i.e.

$$T_p \geqq 284.5\left[\exp\left(\frac{V}{85{,}000}\right)\right] - 660\left(\frac{Lw}{D^4}\right)^{0.685}$$

The dimensions of the capillary are generally: diameter 9 to 15 mils; $L/D^4$ $20\times10^{-4}$ to $100\times10^{-4}$, preferably $20\times10^{-4}$ to $70\times10^{-4}$, mils$^{-3}$, when spinning such throughput as to obtain filaments of 4 to 7 denier per filament.

For copolyesters, e.g. a 90/10, by weight, copolymer of ethylene terephthalate and 2,2-dimethyl propylene terephthalate, the numerical values of skin-core may be different from those for poly(ethylene terephthalate), but it has been found possible to reduce skin-core by practicing the same process techniques as for homopolymer, and thus produce useful filaments by spinning this copolymer at these extremely high speeds. Copolymer filaments can be used in the form of continuous filamentary yarns or tows, and as staple fiber, either alone or in admixture with poly(ethylene terephthalate) filaments and or other filamentary materials.

There is also provided a process for draw-texturing poly(ethylene terephthalate) continuous filamentary yarns having the above properties.

Draw-textured yarns of poly(ethylene terephthalate) continuous filaments having a dye-at-the-boil capability, a loss modulus peak temperature ($T_{E''Max}$) of 115° C. or less, and a temperature at the maximum shrinkage tension ($T_{max}ST$) of at least 258° C. are also provided.

BRIEF DESCRIPTION OF THE DRAWINGS

FIGS. 1 and 2 are discussed hereinafter in relation to process aspects of the invention.

FIG. 3 is a graph plotting the skin-core value ($\Delta_{95\text{-}5}$) against the stress at 20% extension ($\sigma_{20}$) for poly(ethylene terephthalate) filaments spun at high withdrawal speeds, i.e. having $\sigma_{20}$ values above 1.6 gpd, and is discussed after Example 44.

YARN CHARACTERISTICS AND MEASUREMENTS

Figure 1:
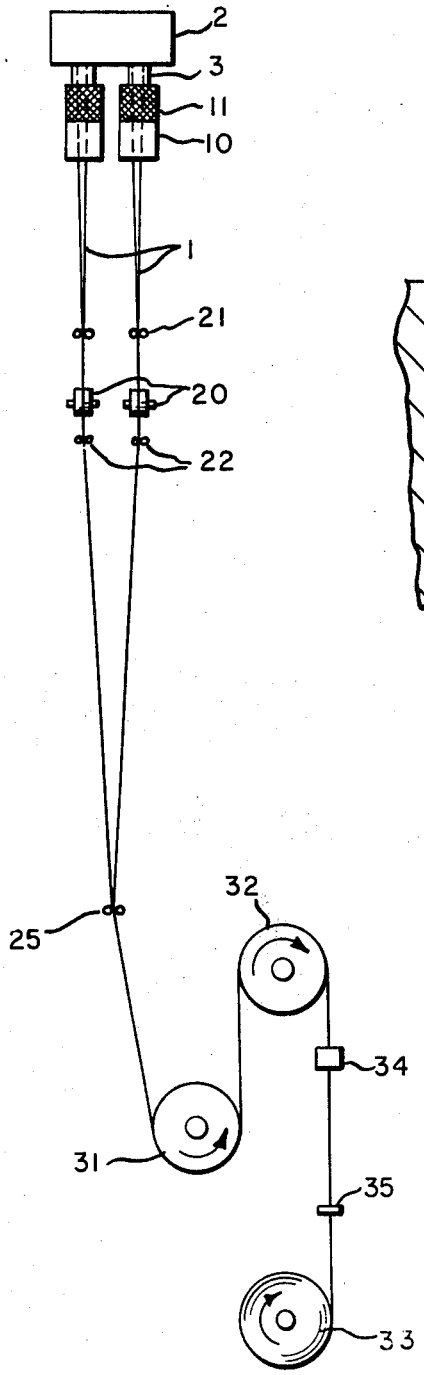
FIG. 1 is a schematic representation of a typical process for high speed spinning for use in preparing filaments according to the invention.

Since this invention concerns novel filaments, characterized by special measurements, it may be helpful at this point to describe and define various characteristics and measurements that are used throughout this application. These characteristics and measurements are grouped together here for convenience, although some are standard. The novel filaments will generally be used in the form of yarns or tows, the tows may be processed into staple fiber and yarns, or be used as such, the yarns will generally be processed into fabrics, and the fabrics may be processed into garments, or used for other purposes, e.g. upholstery, or the filaments may be processed into nonwoven webs, e.g. in the form of spunbonded or spun-laced webs. The following measurements, however, are, for convenience, described in relation to a multifilament yarn of continuous filments, unless otherwise indicated.

The *tenacity, elongation, initial modulus* and *stress at 20% extension* ($\sigma_{20}$) are measured on an Instron Tester TTB (Instron Engineering Corporation) with a Twister Head made by the Alfred Suter Company and using 1-inch × 1-inch flat-faced jaw clamps (Instron Engineering Corporation) with a 10-inch sample length, 2 turns of twist per inch at a 60% per minute rate of extension at 65% Relative Humidity and 70° F.; tenacity and $\sigma_{20}$ values are calculated on the unstrained denier of the yarn. The tenacity and initial modulus increase with the spinning speed, while the elongation decreases, as a general rule, and so the yarns (as-spun) are distinguished from partially-oriented yarn (POY), e.g. prepared by spinning at about 3000 meters/minute, by having a higher tenacity and a lower elongation. Preferred values are a tenacity of at least 3.2 grams per denier (gpd), especially at least 4 gpd, and an elongation of less than 75%, especially 45% or less. The stress at 20% extension ($\sigma_{20}$) also increases with spinning speed, as a general rule, for the as-spun yarns, and is at least about 1.6 gpd, corresponding to a spinning speed of about 5000 meters/minute. The advantage of as-spun filaments according to the invention generally increases as the $\sigma_{20}$ value increases, especially at $\sigma_{20}$ values over about 2 gpd, corresponding to about 6000 yards/minute (about 5500 meters/minute), and more particularly at $\sigma_{20}$ values over about 2.6 gpd since yarns of such filaments are generally "hard".

A yarn can be considered "hard" if its modulus decreases continuously after its maximum, when plotted against the extension. The modulus at any given extension is given by (d (stress)/d (extension)), i.e. the slope of the curve of stress plotted against extension. When the modulus is plotted against the extension, the modulus rises rapidly to its maximum and then decreases, eventually reaching a limiting value before the sample breaks.

*Hard yarns* are, therefore, hereby defined as those whose modulus at an extension between 3% and 8% (Modulus$_{E\,3\text{-}8}$) is greater than the limiting modulus that is observed as the extension increases from 8% to 20%.

By spinning at a sufficiently high speed and by maintaining a low skin-core value, it is possible to prepare hard continuous filaments according to the invention directly, i.e. merely by spinning without arranging for a separate drawing step after cooling below the second-order transition temperature.

Hitherto, as-spun commercial polyester yarns (prepared by low speed spinning (split process) and partially-oriented yarns) have had a modulus which has decreased below the limiting value and has then increased to its limiting value. Such yarns yield under ordinary stresses, and have not been useful as such, e.g. for textile applications, but have to be drawn. Drawing (e.g. in a split process, a coupled process or as part of a draw-texturing operation) changes the slope of the modulus plotted against extension, so that the modulus does not dip below its limiting value significantly, i.e. ignoring minor oscillations as the limiting value is approached. Such draw yarns are hard yarns, like those now discussed according to the present invention, but have been made commercially by first spinning and then drawing in a separate operation after cooling below the second-order transition temperature of the solidified polyester.

Thus, yarns whose $\sigma_{20}$ values are at least 2.6 gpd (corresponding to about 7000 yards/minute about 6400 meters/minute) are especially useful. Wound packages containing at least 60,000 meters, and preferably more than 250,000 meters of such hard continuous filament polyester yarn having $\sigma_{20}$ at least 2.6 gpd, can be prepared directly by spinning such filaments with low skin-core values according to the present invention.

As the spinning speed and $\sigma_{20}$ value both increase, it becomes increasingly difficult to collect useful filaments because of apparatus limitations, e.g. the windups that are available now. With increasing spinning speed and $\sigma_{20}$, it also becomes more difficult, in practice, to avoid making filaments with high skin-core values. Thus, with present limitations, e.g. of apparatus, it has not been practical to windup filaments of $\sigma_{20}$ much greater than about 3.7 gpd, corresponding to about 8000 yards/minute (about 7300 meters/minute). Other filament collection methods, however, already exist, e.g. piddlers, and as spinning speeds increase beyond 8000 ypm, it will still be desirable to maintain a low skin-core value even at such increased spinning speeds, i.e. in filaments having higher $\sigma_{20}$ values. As indicated hereinafter in more detail in relation to FIG. 3, the relationship between $\sigma_{20}$ and a desirable maximum practical skin-core value is not linear over the whole range of $\sigma_{20}$, but curves upward. In practice, at $\sigma_{20}$ values over about 3 gpd, corresponding to a spinning speed of about 7000 meters/minute, e.g. over a range of $\sigma_{20}$ of about 3 to about 4 gpd, the skin-core values may be lower than a maximum given by the relationship $$\Delta_{95\text{-}5} \leqq 0.0065\sigma_{20} - 0.0100.$$

The skin-core value of any yarn is generally reduced by drawing, but drawing increases amorphous orientation, which reduces dyeability, and also reduces the long-period spacing.

A high *long-period spacing* (LPS, above 300 Å) is a characteristic of most of the as-spun filaments of the invention. This long-period spacing is obtained from small-angle x-ray scattering (SAXS) patterns made by known photographic procedures. X-radiation of a known wavelength, e.g., $CuK_\alpha$ radiation having a wavelength of 1.5418 A, is passed through a parallel bundle of filaments in a direction perpendicular to the filament axis, and the diffraction pattern is recorded on photographic film. Pinhole collimation must be used in order to observe the four-point or quadrant diagram characteristic of these samples. An evacuated small-angle camera of moderately high resolution is required to resolve the quadrant spots. Matched pinholes of 0.25 mm diameter spaced 15 cm apart and a sample-to-film distance of 32 cm with a 2.5 mm diameter beam stop near the film are sufficient to resolve the diagram. Slit-smearing small-angle diffractometers and cameras cannot be used because the smeared continuous scatter near the main beam obscures the quadrant spots. The repeat distance ('d') is calculated from a measurement of the separation of the quadrant spots in a direction parallel to the fiber axis by application of the Polanyi equation $$n\lambda = d \sin \phi,$$

where n is the constant 1 (first order 'layer line'), $\lambda$ is the wavelength and $\phi$ is half the angular separation of the quadrant spots measured parallel to the fiber axis. For a sample to film distance, f, and a spot separation, l, and since $\phi = \sin \phi = \tan \phi$ at small angles:

$$d = (2\lambda f)/l = 986.75/l(\text{mm})$$

for f=320 mm and $\lambda$=1.5418 A. A more detailed description of the methods of obtaining and interpreting small-angle x-ray data may be found in the book 'X-ray Diffraction Methods in Polymer Science' by L. E. Alexander, published by John Wiley and Sons, New York, N.Y. (1969). The camera is described in Chapter 2, section 3.5 and the interpretation in Chapter 5, section 5.2. The measurement of long-period spacing is time-consuming. The measurement has not been carried out on every single Example, since the correlation between spinning speed and long-period spacing became apparent from many measurements.

The long-period spacing of prior art commercial yarns, and of other filaments spun at lower withdrawal speeds typically have values less than 300 Å and usually are characterized by the more usual two-point meridional scattering pattern. For prior art yarns having such scattering patterns the Bragg equation is used as described in Chantry & Molini U.S. Pat. No. 3,216,187 (Column 3). As the spinning speed increases, the long-period spacing of the filaments of the invention increases to a maximum and the decreases below 300 Å again. The precise speed at which the long-period spacing decreases below 300 Å will depend on various factors, especially polymer temperature ($T_p$), but is generally over 7000 yards/minute, and usually over 7500 yards/minute. Annealing as-spun filaments of the invention significantly reduces their long-period spacing below 300 Å. Such filaments still have useful dyeability and thermal stability.

The *density* ($\rho$) is measured as disclosed in Piazza & Reese U.S. Pat. No. 3,772,872 (Column 3) or in ASTM D1505-63T. Density of the polymer is a convenient measure of crystallinity. The densities given in the Examples are of the polymer and have been corrected for $TiO_2$ content. Yarns according to this invention are generally of (polymer) density at least 1.365, preferably at least 1.37 g/cm$^3$, and generally less than 1.425, preferably less than 1.4 g/cm$^3$. These densities are higher than for as-spun yarns prepared by low speed spinning or for commercial partially-oriented yarns. The crystallinity of such prior commercial yarns has been raised to desirable values by drawing and annealing, which reduces dyeability.

The *crystal size* (CS) is estimated from the Scherrer formula $CS = K\lambda/\beta\cos\theta$ where K is taken to be unity; $\lambda$ is 1.5418 Å, the wavelength of $CuK_\alpha$ X-rays; $\theta$ is the Bragg angle of diffraction; $\beta$ is line broadening corrected for instrumental broadening by $\beta^2 = B^2 - b^2$ where B is the observed broadening and b is the instrumental broadening as measured on a ZnO pattern assuming infinitely large crystallites (all measurements in radians). The crystal size (CS) is measured using the diffraction at a diffraction arc $2\theta = 17.5°$ for the 010 diffraction arc, and is measured radially along the equator, i.e. at its maximum intensity, by the techniques described by H. P. Klug and L. E. Alexander in "X-ray Diffraction Procedures", John Wiley and Sons, Inc. New York (1954), Chapter 9.

The filaments of this invention preferably have crystal sizes that are greater than about 55 A, especially greater than 70 Å, and that are preferably related to the fiber density by the relation $CS \geqq (1250\rho - 1670)$ Å. Prior art yarns that are crystallized in other textile processes, e.g., spin/draw and draw-set-texturing are considered to have crystal sizes that are less than those formed by spinning at these extremely high speeds, at any given value of density according to the above expression. The large crystal size is a characteristic of filaments of the invention, whether as-spun or annealed, unlike the long-period spacing.

*Birefringence* ($\Delta$) is a measure of the orientation of the polymer chain segments. It is measured as in British Patent No. 1,406,810 (pages 5 and 6). The value reported ($\Delta_5$) is the mean for 10 filaments measured near the center of each filament ($\pm 5\%$ away from the filament axis). Preferred values are at least 0.09, which distinguishes from partially-oriented yarns, to not more than 0.14, which distinguishes from conventionally drawn yarns.

As stated already, it is important to have a low *differential birefringence* ($\Delta_{95\text{-}5}$) when spinning poly (ethylene terephthalate) filaments as the spinning speed increases to extremely high values from about 5000 meters/minute. This desideratum is referred to herein as low "skin-core" in the sense that it is important to minimize any skin on the surface of the filament, such skin being detectable by a large difference between the birefringence near the surface and that near the center of the filament, i.e. it is important to minimize this difference. It becomes more difficult, in practice, to achieve this as the $\sigma_{20}$ value increases because of any increase in spinning speed. Differential birefringence ($\Delta_{95\text{-}5}$) is defined herein as the difference between the chord average birefringence near the surface of a filament ($\Delta_{95}$) and the chord average birefringence within the filament near its center ($\Delta_5$).

A double-beam interference microscope, such as is manufactured by E. Leitz, Wetzlar, A. G., is used. The filament to be tested is immersed in an inert liquid of refractive index $n_L$ differing from that of the filament by an amount which produces a maximum displacement of the interference fringes of 0.2 to 0.5 of the distance between adjacent undisplaced fringes. The value of $n_L$ is determined with an Abbe refractometer calibrated for sodium D light (for measurements herein it is not corrected for the mercury green light used in the interferometer). The filament is placed in the liquid so that only one of the double beams passes through the filament. The filament is arranged with its axis perpendicular to the undisplaced fringes and to the optical axis of the microscope. The pattern of interference fringes is recorded on T-410 Polaroid film at a magnification of 1000×. Fringe displacements are related to refractive indices and to filament thicknesses, according to the equation:

$$\frac{d}{D} = \frac{(n - n_L)t}{\lambda}$$

where n is the refractive index of the filament, $\lambda$ is the wavelength of the light used (0.546 micron), d is the fringe displacement, D is the distance between undisplaced adjacent fringes, and t is the path length of light (i.e., filament thickness) at the point where d is measured.

For each fringe displacement, d, measured on the film, a single n and t set applies. In order to solve for the two unknowns, the measurements are made in two liquids, preferably one with higher than one with lower refractive index than the filament according to criteria given above. Thus, for every point across the width of the filament, two sets of data are obtained from which n and t are then calculated.

This procedure is carried out first using polarized light having the electric vector perpendicular to the filament axis, at measuring points 0.05, 0.15, . . . 0.85, 0.95 of the distance from the center of the filament image to the edge of the filament image. This procedure yields the chord average $n\perp$ refractive index distribution. The $n\parallel$ refractive index distribution is obtained from one additional interference micrograph with the light electric vector polarized parallel to the filament axis (using an appropriate immersion liquid preferably having a refractive index slightly higher than that of the filament). The t (path length) distribution determined in the $n\perp$ measurement is used for the $n\parallel$ determination.

Birefringence ($\Delta$), by definition is the difference ($n\parallel - n\perp$). Differential birefringence $\Delta_{95\text{-}5}$ is then the difference between $\Delta$ at the 0.95 point and the 0.05 point on the same side of the filament image. The value of $\Delta_{95\text{-}5}$ for a filament is the mean of the two $\Delta_{95\text{-}5}$ values obtained on opposite sides of the filament image.

In all of the above calculations, all linear dimensions are in the same units and are converted, where necessary, either to the magnified units of the photograph or to the absolute units of the filament.

This procedure is intended to be applied to filaments having round cross sections. It can also be applied to filaments having other cross sections by changing only the definition of the averaging procedure to obtain $\Delta_{95\text{-}5}$. The "skin" as defined above amounts to about 10% of the fiber volume. In applying this to a non-round fiber the portion defined as skin should also include the outer 10% of the fiber, but there must be sufficient averaging with respect to different positions in the fiber skin, effected by rotating the fiber about its axis to various angles, to ensure that the skin birefringence value is truly representative.

$\Delta_c$ and $\Delta_{am}$ are the *birefringence* values for the *crystalline* and *amorphous* phases, respectively, and $\pi$ is the *crystalline orientation angle.* For partly oriented semi-crystalline polymer filaments, the contribution of the crystalline and amorphous polymer segments to the birefringence ($\Delta$) may be expressed as $\Delta = X\Delta_c + (1-X)\Delta_{am}$, where X is the fraction of crystalline material and may be calculated from the measured polymer density ($\rho$) and the densities of the crystalline phase ($\rho_c = 1.455$ gm/cm$^3$) and of the amorphous phase ($\rho_{am} = 1.335$ gm/cm$^3$) since $$X = (\rho - \rho_{am})/\rho_c - \rho_{am}).$$

The *crystalline birefringence* ($\Delta_c$) is defined as the product of the Hermans' orientation function ($f_c$) and the intrinsic birefringence ($\Delta^\circ_c$) of a perfectly oriented crystalline phase. The approximate value of 0.220 given by J. H. Dumbleton, Journal of Polymer Science, A-2, 6 (1968) page 795 has been used herein for $\Delta^\circ_c$. For typical filaments of the invention with reasonably well-oriented crystals, $f_c$ can be calculated from $f_c \approx 180 - \pi/180$.

The *crystal orientation angle* $\pi$ is the azimuthal angle in degrees at half-maximum intensity of the 100 reflection of the yarn sample ($2\theta = 25.64°$), corrected by subtracting the angular equivalent of the radial breadth of the arc. $\pi$ is preferably not more than 18°, which is smaller than for many prior commercial textile yarns.

The *amorphous birefringence* ($\Delta_{am}$) may, therefore be calculated from the relation $\Delta_{am} = (\Delta - X\Delta_c)/(1-X)$ or from $\Delta_{am} = (\Delta - 0.220 f_c X)/(1-X)$.

The yarns of this invention are characterized by highly oriented crystalline regions with values of $f_c$ typically greater than 0.9 (where a value of 1.0 indicates perfect orientation with respect to the fiber axis) and highly disoriented amorphous regions with birefringence $\Delta_{am}$ less than 0.07 and typically less than 0.06. The amorphous birefringence is considerably less than that observed for conventionally drawn yarns.

The *boil-off shrinkage (BOS)* is measured as in Piazza & Reese U.S. Pat. No. 3,772,872. A yarn having a low boil-off shrinkage of 2–2.5% can be package-dyed without the use of special packages or heat-setting.

The *dry heat shrinkage (DHS,* 160° C.) is unusually low, generally being less than 1% more than the BOS, and is measured in the same manner as the BOS except that the sample is heated in air in a 160° C. oven.

The *HRV* is the relative viscosity measured as in British Patent No. 1,406,810. Preferred textile values are 20 to 24 for poly(ethylene terephthalate).

The *melting point (T melt)* is measured by a Du Pont DTA Thermal Analyzer 900, calibrated with oxanilide (m.p. 251° C.), the sample being heated 20° C./minute under a nitrogen atmosphere. Preferred poly(ethylene terephthalate) yarns have melting points above 258° C., which is higher than usually encountered with prior art yarns.

The *sonic modulus* ($E_s$) is defined by the relation $E_s = \rho V_s^2$ where $\rho$ is the polymer density and $V_s$ is the *sonic velocity* in km/sec as measured with a Morgan dynamic modulus tester according to ASTM procedures [ASTM F89-68, Annual Standards, Part 15, 866–873 (1968)] at a frequency of 10,000 cycles per second and under a tensile load corresponding to about 0.7 gpd at 65% Relative Humidity and 70° F. The filaments of this invention preferably have sonic moduli greater than about $10 \times 10^{10}$ dynes/cm$^2$, whereas commercial yarns spun at lower speeds have values less than $10 \times 10^{10}$ dynes/cm$^2$. Commercial spin/drawn yarns have values of about $15 \times 10^{10}$ dynes/cm$^2$ or more, as do filaments of the invention spun at higher speeds such as 8000 yards/minute.

The *torsional modulus* (G) and *Poisson's ratio* ($\nu$) are useful indicators of filament structure in the transverse direction (e.g. skin-core structure differences), since torsion involves filament deformations perpendicular to the filament axis. The torsional modulus is measured by a Toray Fiber Torsional Rigidity Analyzer, which measures the torque (M) for different twist angles ($\psi$), where $\psi$ is defined as the rotation in radians of two filament cross-sections relative to each other divided by the distance between them. The filament specimen to be tested is carefully mounted to two sample tabs with Du Pont "Duco" cement. The specimen is then clamped into position using the tabs. This procedure reduces handling of the specimen and the possibility of filament slippage in the clamps. Tension on the specimen is held constant at 0.5 gram and all measurements are made at 60% relative humidity (R.H.) and 70° F.

Initially torque (M) and twist angle ($\psi$) are linearly related with a proportionality constant $S_T$, the measure of torsional rigidity as given by $M = S_T\psi$ where the value of $S_T$ is described by $S_T = K_T A^2 G$, in which $K_T$ is a shape factor (0.159 for round fibers); A is the cross-sectional area; and G is the shear modulus. Values of $K_T$ and a discussion of the relationships are given in S. Timoshenko and T. N. Goodier, "Theory of Elasticity", McGraw Hill, N.Y. (1951). The average value of G is defined by the expression: $\int r^4 G dr / \int r^4 dr$, where G is a function of the radius r. It is therefore readily seen that the average shear modulus (G) is sensitive to the "skin" structure. A measure of the anisotropy (e.g., uniaxial orientation) of a filament may be given by the ratio of the elongational modulus (E) and the shear modulus (G), $E/G = 2(1+\nu)$, where $\nu$ is the Poisson's ratio. For perfectly isotropic incompressible materials the Poisson's ratio is 0.5 and the ratio of the elongational and shear moduli is exactly 3. In the calculation of $\nu$ the elongational modulus is taken to be given by that determined from sonic velocity, i.e., the sonic modulus ($E_s$).

The yarns of this invention preferably have values of G of about 1.0 to $1.6 \times 10^{+10}$ dynes/cm$^2$ and values of $\nu$ of about 2 to 5 (see Table XIII). The values of $\nu$ and G increase, in general, with increasing spinning speed and with decreasing dpf. At any given spinning speed, yarns with high $\Delta_{95\text{-}5}$ values are observed to have higher values of G giving rise to lower values of $\nu$. Filaments characterized by larger values of G are more rigid than expected for a given level of bulk molecular orientation, are found to have a larger skin-core structure, and are more brittle on torsional strain. Lower skin-core structures (as defined by differential birefringence $\Delta_{95\text{-}5}$) apparently correlate with lower torsional moduli.

*Flex resistance* is measured as described in U.S. Pat. No. 3,415,782, col. 8, line 51 to col. 9, line 6, and is a measure of the brittleness of filaments to blending (flexing) deformations. For staple filaments this property is important and the staple filaments of this invention are found to have 2–3× the flex resistance of commercial staple filaments.

The dyeability of various yarns is compared herein by measuring their disperse dye rate, DDR, which is defined hereby as the initial slope of a plot of percent in filament by weight versus the square root of dyeing time which is a measure of a dye diffusion coefficient (if corrected for difference in surface to volume ratio). The values of the disperse dye rate are normalized to a "round filament" of 4.7 denier per filament (dpf) having a density of 1.335 gms/cm$^3$, i.e. of an "amorphous" 160-34 round filament yarn, as a *relative disperse dye rate, RDDR,* defined by the relation:

$$RDDR = DDR(measured) \times [dpf/4.7)(1.335/\rho)(100-/100-BOS)]^{\frac{1}{2}}$$

where $\rho$ is the polymer density; dpf is the filament denier; and BOS is the yarn boil-off shrinkage. The RDDR value is approximately independent of the surface-to-volume ratio of the dyed filaments and reflects differences in filamentary structure affecting dye diffusion.

The disperse dye rates are measured using "Latyl" Yellow 3G (CI 47020) at 212° F. for 9, 16 and 25 minutes using a 1000 to 1 bath to fiber ratio and 4% owf (on weight of fiber) of pure dyestuff. The dyestuff is dispersed in distilled water using 1 gram of "*Avitone T*" (a sodium hydrocarbon sulfonate) per liter of dye solution. Approximately 0.1 gram yarn sample is dyed for each interval of time; quenched in cold distilled water at the end of the dyeing cycle; rinsed in cold acetone to remove surface held dye; air dried and then weighed to four decimal places. The dyestuff is extracted repeatedly with hot monochlorobenzene. The dyestuff is extracted repeatedly with hot monochlorobenzene. The dye extract solution is then cooled to room temperature ($\approx$70° F.) and diluted to 100 ml with monochlorobenzene. The absorbance of the diluted dye extract solution is measured spectrophotometrically using a Beckmann model DU spectrophotometer and 1 cm corex cells at 449$\mu$. The % dye (by weight) is calculated by the relation:

$$\%\ dye\ (wt.) = \frac{absorbance}{sample\ wt.\ (gms)} \times \frac{dye\ molecular\ wt.}{extinction\ coefficient} \times \frac{volume\ of\ diluted\ dye\ extract\ solution\ (ml)}{1000} \times 100$$

The ratio of the dye molecular weight and molar extinction coefficient is 0.00693 gm. And the measured value of DDR is the slope of the plot of % dye (by weight) versus dyeing time (min)$^{\frac{1}{2}}$.

Commercial coupled spin/draw yarns are found to have RDDR values of $\approx$0.025 and may require up to 5 g/l of carriers to dye-at-the-boil. The as-spun yarns of this invention have RDDR values greater than 0.050 and typically >0.060. Although it may be desirable to use levelling agents and/or small amounts of carrier in practice when dyeing yarns of this invention, especially to deep shades, such yarns do have a capability of being dyed by disperse dyes without a carrier.

The dyeability of filaments of the invention depends to some extent on the process conditions used to prepare the filaments. The advantage of enhanced dyeability, as compared with prior commercial hard yarns, is first that the yarns of the invention can be dyed at the boil without a carrier, whereas prior commercial hard yarns needed higher temperatures and pressures and/or the presence of a carrier, and second that the yarns of the invention can be dyed more rapidly, i.e. the time required for dyeing can be significantly reduced without sacrificing depth of dyeing. In some cases, depending on the dyestuff, it may be possible to increase the depth of dyeing, provided that the preferred high shear spinneret is used to prepare the filaments of the invention.

*K/S* is a measure of apparent dye depth (visual color intensity) according to the equation $$K/S = (100-R)^2/200\ R$$

wherein R is the percent light (of wavelength corresponding to that of maximum absorption) reflected from the sample compared to that reflected from a barium sulfate plate (*Color in Business, Science, and Industry,* Deane B. Judd, Gunter Wyszecki, 2nd Edition, John Wiley & Sons, 1963, at page 289). A Diano Colorimeter (available from Diano Corporation, Mansfield, Mass.) is used for the measurement.

The draw-textured yarns of the invention are different from prior commercial textured poly(ethylene terephthalate) yarns in that they can be dyed at the boil (i.e. with a dispersed dyestuff without a carrier). The dyeability of the draw-textured yarns increases, in general, with the spinning speed of the feed yarns (whereas the dyeability of the feed yarns, i.e. before draw-texturing, decreases, in general, with the spinning speed). Prior feed yarns for draw-texturing (i.e. partially-oriented yarns) have had a dye-at-the-boil capability, but the draw-textured yarns have lost this capability because of the drawing operation, which has reduced the dyeability. For feed yarns for draw-texturing purposes it is desirable that the dyeability (of the textured yarns) not be significantly affected by the spinning speed, since small changes in spinning speed (when making the feed yarn) would cause dyeing defects in the final fabrics containing the textured yarns. It is preferred, therefore to use draw-textured yarns prepared from feed yarns of $\sigma_{20}$ at least about 2.0 gpd, i.e. spun at more than about 5500 meters/minute, since the increase in the differential dyeability of the draw-textured yarns becomes less significant as the spinning speed of the feed yarns is increased, e.g., to 6400 meters/minute, corresponding to an $\sigma_{20}$ of about 2.6 gpd.

The draw-textured yarns of the invention preferably have a RDDR value >0.045; especially >0.055, and can be characterized by a *loss modulus peak temperature* ($T_{E''max}$) of 115° C. or less and by a *temperature at the maximum shrinkage tension* ($T_{maxST}$) of at least 258° C.

The *Shrinkage tension* (Sh. Tens.) is measured using a shrinkage tension-temperature spectrometer (The Industrial Electronics Co.) equipped with a Stratham Load Cell (Model UL4-0.5) and a Stratham Universal Transducing CEU Model UC3 (Gold Cell) on a 10 cm loop held a constant length under an initial load of 0.005 gpd and heated in an oven at 30° C. per minute and the temperature at the maximum shrinkage tension ($T_{maxST}$) is noted. The maximum shrinkage tension of the as-spun filaments of the invention are typically less than 0.2 gpd which distinguishes these filaments from commercial spin/draw filaments and from "space-drawn" filaments as described in French No. 74.32295. The $T_{maxST}$ for the draw-textured yarns is found to increase with spinning speed (of the feed yarn) and is preferably over 260° C., especially about 265° C. or more, in contrast to 245°–250° C. for textured drawn yarns and 255° C. for draw-textured partially-oriented feed yarns.

The relation between the dyeability of poly (ethylene terephthalate) and the *loss modulus peak temperature* ($T_{E''max}$) has been noted by Dumbleton et al., J. Applied Polymer Science, Vol. 12 (1968) pp 2491–2508, see also Kolloid-Z, Vol. 228 (1968) pp 54–58. A $T_{E''max}$ of 115° C. or less, preferably 110°–112° C., distinguishes draw-textured yarns of the invention from prior commercial textured yarns, namely 131° C. for textured drawn yarns and 118° C. for draw-textured partially-oriented yarns.

The measurement of $T_{E''max}$ is made as follows:

The test instrument is a modified "Rheovibron" model DDV II; the original oven has been modified for rapid heating maintaining the same geometry; (a standard Rheovibron oven could be used); the amplitude factor step attenuator is replaced with a 10-turn, 1500Ω "Helipot" and the original, spring loaded clamps are replaced with screw fastening magnesium alloy clamps having grooved gripping surfaces and weighing 3.5 g each, including the support rod.

The sample of textured yarn of about 160 denier (determined by weighing a sample of length 9.0 cm measured under a tension of 100 g) of sample gauge length (i.e. distance between clamp jaws) set at 2.00±0.1 cm at room temperature and at zero tension.

Measurements are performed at a constant static stress of 0.5 gpd based on the initial denier. This static stress is applied when the sample is cold and is not relaxed during the test. This stress is maintained manually using the "stress" measuring position and the sample-length adjustment knob. There is some creep, so that frequent rechecking of the static stress component is necessary. The static stress is not allowed to fall below 0.45 gpd nor to rise above 0.55 gpd when the sample is heated above 30° C. The sample is equilibrated at each measuring temperature for 25 minutes (includes heat up time), 15 minutes under static load only, and 10 minutes under combined static and dynamic loads, before the loss tangent and dynamic modulus are measured.

The sample length in this test is set to 2.00±0.1 cm at room temperature. At higher temperatures the sample length necessary to maintain 0.5 gpd static tension is greater and the modulus measurements are corrected for this length change. Modulus measurements are also corrected for the compliance of the stress (T-1) gauge. No corrections for gauge compliance or mass of the clamps are applied to the loss tangent measurement. In this test the dynamic stress amplitude is maintained constant at 0.25 gpd at test temperatures equal to or less than 120° C.

In the event that at higher temperatures (above 120° C.) the instrument's maximum dynamic displacement amplitude will not produce a dynamic stress of 0.25 gpd, the displacement amplitude is set at this maximum value and the test is continued at whatever lower dynamic stress amplitude obtains. The static stress is maintained constant as described above. The measurement temperatures are 80°, 90°, 95°, 100°, 105°, 110°, 115°, 120°, 130° and 140° C.±1° C. Throughout a test of one specimen the test temperature intervals are 5°±1° C., the measuring frequency is 35 Hz.

Loss modulus peak temperatures are interpolated from the data by fitting the highest measured loss modulus value, the two values at 5° and 10° C. higher temperature and the two values at 5° and 10° C. lower temperature and the respective test temperatures to a parabola using the method of least squares. To assure temperaure calibration, a calibrated thermocouple in contrast with a test specimen clamped in the specimen clamps is used to measure the temperature difference between a process temperature thermocouple which is fixed in position close to the sample and the true sample temperature. In subsequent tests the specimen temperature is defined as the "process" temperature plus (or minus as appropriate) the measured temperature difference.

The *crimp contraction* values after heating (herein termed $CCA_5$) are measured as the crimp development ($CD_w$) described in Piazza & Reese U.S. Pat. No. 3,772,872 in col. 4, where w=5 mg/denier.

*Work Recovery*, $W_x$, from x=1, 3, and 5% elongation is a measure of the freedom from permanent realignment of the polymer molecules following stretching of the fiber or yarn. The ratio of the work done by the polymer molecules in attempting to return to their original alignment following stretching to a predetermined elongation to the work done on the sample during stretching is termed the work recovery. An Instron tester, Model TT-B or TM (Instron Engineering Crp) fitted with a tensile load cell, Model B and pneumatic air clamps with 1-inch×1-inch jaw faces were used. The samples were conditioned at 130° F. for 2 hours and then at 70° F. and 65% RH for 16 hours. In this test the conditioned sample is stretched at the rate of 10% of its test length per minute until it has reached 1% elongation, after which it is held at this elongation for 30 sec. and then allowed to retract at a controlled rate of 10% per minute, based on its original length. $W_{1\%}$ is calculated as the percentage ratio of the area under the controlled load-relaxation curve to the area under the stretching load-extension curve. The above cycle is repeated for 3% and 5% elongations based on the original sample length (i.e. correcting for any developed slack in the sample from the previous cycle).

Yarns according to the invention are characterized by unique properties in the sense that they have not hitherto been found in commercial poly(ethylene terephthalate) yarns, namely: (1) hard yarn-like tensile properties for as-spun yarns of high $\sigma_{20}$ (preferably ≧2.6 gpd); (2) low boil-off shrinkage in the as-spun condition; (3) good thermal stability at elevated temperatures, e.g., up to 200° C.; and (4) dye-at-the-boil capability without carrier. The textured yarns have similar properties with slightly reduced dyeability, as compared with the feed yarns from which they were prepared. Although the invention is not intended to be limited to any theory, the following general comments may be helpful in relation to polyester filaments that have been prepared by spinning at these extremely high speeds that overlap the speed range taught by Hebeler in U.S. Pat. No. 2,604,667.

The low shrinkage and good thermal stability at elevated temperatures are attributed to the large crystals. On annealing the as-spun filaments, the long-period spacing, as measured by SAXS, precipitously decreases in value from over 300 Å to about 150 Å.

The annealed structure now resembles that of conventional polyester structures giving the familiar two-point SAXS pattern, while the as-spun yarns give the four-point pattern. The interpretation of the crystal "structures" as represented by the change in SAXS patterns is schematically represented by A. Peterlin in Textile Research Journal, January, 1972, p. 21 and is also discussed by L. E. Alexander in "X-ray Diffraction Methods in Polymer Science", John Wiley and Sons, Inc., New York (1969), pp. 24–26, 332–342. Other polyester yarns are found to have four-point diagrams, such as yarns drawn sufficiently to induce fibrillation (H. Berg, Chemiefasern/Textilindustrie, March, 1972, pp. 215–222); but these yarns are found to have LPS values less than 200 A. The new annealed yarns differ from conventional annealed yarns in that the crystal size is larger for any given density.

The improved dyeability of the filaments is partially attributed to their large crystals and low amorphous orientation. An increase in crystallinity and/or a decrease in crystal size will reduce potential dyeability. Increasing the orientation of the amorphous chains decreases the segmental chain mobility as indicated by a larger $T(E''_{max})$ and reduced dyeability. The above structural features appear characteristic of yarns spun at extremely high speeds, but to make a useful yarn with these desirable properties at these speeds, it is necessary to avoid forming a skin on the filaments. The absence of any significant skin is indicated by low $\Delta_{95\text{-}5}$ values and by low torsional moduli G. The "concave" upward dependence of $\Delta_{95\text{-}5}$ versus spinning speed (i.e., $\sigma_{20}$) is expected to be similar to that of the bulk birefringence and should therefore be an increasing function of $\sigma_{20}$ which is consistent with the "shape" of the plot of $\Delta_{95\text{-}5}$ versus $\sigma_{20}$ in FIG. 3, where the increase in $\Delta_{95\text{-}5}$ is simplified and represented by two linear relations.

DETAILED DESCRIPTION OF PROCESS ASPECTS

A process by which round filaments may be prepared in its various aspects will be further described with reference to the accompanying drawings.

Referring to FIG. 1 showing a typical high speed spinning apparatus, for use in preparing filaments according to the invention, molten polyester is melt spun through orifices in a heated spinneret block 2 and cooled in the atmosphere to solidify as filaments 1. As the molten polyester emerges from block 2, it is preferably protected from the atmosphere by a metal tube 3 (insulated from the face of the spinneret and block by a gasket) surrounding the filaments as they pass between the orifices and a zone 10 in which cooling air is introduced, preferably symmetrically around the filaments through the holes in a foraminous metal tube 11, essentially as described in Dauchert U.S. Pat. No. 3,067,458. The filaments pass between convergence guides 21, which are arranged so as to confine the filaments, and then in contact with rolls 20 which rotate in a bath of spin-finish and thus apply the desired amount of finish to the solid filaments, and then pass another set of guides 22 which hold the filaments in contact with the finish roll 20 and direct the filaments to the next set of guides 25, and on to the windup system, which comprises a first driven roll 31, a second driven roll 32, a traversing guide 35 and a driven take up roll 33, the yarn being interlaced by an interlacing jet 34.

Figure 2:
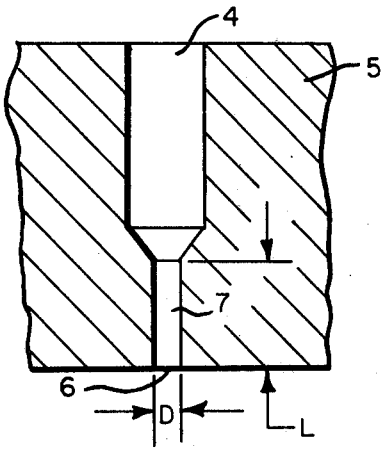
FIG. 2 shows in partial cross-section a view through one form of spinneret that may be used in a preferred process according to the invention.

FIG. 2 shows part of a spinning plate with an orifice capillary that is of generally conventional shape, except for the dimensions, as will be mentioned in greater detail hereinafter. Molten polyester is pumped through a passage 4 in spinneret plate 5, which is located at the base of block 2 in FIG. 1. The lower portion of passage 4 is a capillary 7 that is of diameter smaller than that of the upper portion, and ends in orifice 6, through which the molten polyester emerges. The diameter (D) and length (L) of capillary 7 are indicated in FIG. 2.

Many factors are important when spinning polyester filaments at extremely high speeds. It is possible to control the skin-core value, and thus improve the quality of the filaments and/or the continuity of the spinning process by proper attention to these factors, as will be explained hereinafter. An important factor is the type of spinneret that is chosen. It has also been found preferable to control the temperature of the polymer after it passes through most of the filter pack and before it passes through the spinneret orifices, since control of the temperature of the spinneret block alone was not adequate for controlling skin-core value.

The polymer is passed into the spinneret block in molten form, and its temperature can be measured, e.g., by a calibrated thermocouple, before it is further heated by friction as it passes the metering pump, the filter pack and through the orifices in the spinneret plate. This measured temperature can be considered the initial temperature ($T_i$), in contrast to the block temperature ($T_B$). The temperature can also be measured before the polymer passes through the spinneret plate. This is an important temperature, and is referred to hereinafter in the Examples as the polymer temperature ($T_p$), being the average (bulk) temperature measured in the filter pack at a point 50–100 mils above the center of the spinneret plate. The polymer is further heated, as it passed through the orifice in the spinneret plate, to an average polymer temperature at extrusion ($T_{ex}$). If a higher shear spinneret is used, there is a significant difference ($\Delta T$) between the temperature at the surface of the polymer ($T_s$) as it is extruded at the wall of the capillary and that in the center of the emerging filament. This difference ($\Delta T$) and the difference between $T_{ex}$ and $T_p$ are considered to depend mainly on the pressure drop in the spinneret capillary, and are both approximately power-law functions of $Lw/D^4$ pph mils$^{-3}$, where L, D and w are, respectively, the length and diameter of the capillary in mils and the capillary throughput in pounds per hour (pph). Thus, the surface temperature ($T_s$) can be expressed as an approximation:

$$T_s = T_p + b\left(\frac{Lw}{D^4}\right)^m$$

where b and m are constants.

The minimum desired surface temperature as the spinning speed (V) increases can be expressed by:

$$T_s \geqq T'[\exp(V/a)]$$

where T' is a constant, being a temperature, and a is a constant. One can express the (simplified) requirement for a high (i.e., minimum desired) temperature ($T_s$) at the surface of the filament being extruded in terms of the polymer temperature ($T_p$), being required to be above a minimum value which varies according to the following relationship with the spinning speed (V), the length (L) and diameter (D) of the capillary and the througput (w) per capillary, as:

$$T_p \geqq T'\left[\exp\left(\frac{V}{a}\right)\right] - b\left(\frac{Lw}{D^4}\right)^m$$

where a, b, m and T' are constants. This relationship indicates practical ways to maintain a low skin-core value as the spinning speed V increases. Thus, if $T_p$ is to be kept constant, as V increases, then $Lw/D^4$ should be increased, i.e. a higher shear spinneret (increased $L/D^4$) is a preferred way of maintaining low skin-core values with increasing V. If the same spinneret ($L/D^4$) is retained, as V increases, $T_p$ should be increased. If a lower denier filament is desired (lower w) at the same speed V, then a higher shear spinneret (increased $L/D^4$) or higher $T_p$ should be used.

It will be understood that if additional heat is introduced to the polymer at the spinneret plate, e.g., by a separate heater, then the polymer temperature ($T_p$) should be lower to get the same surface temperature ($T_s$), but this method is not preferred because of the cost of such additional heat.

Thus, improvements in polyester filaments, that have been wound up at very high speeds, have been achieved according to the invention by using a special spinneret with orifice capillaries providing high shear by reason of the dimensions, specifically the diameter (D) and the quotient ($L/D^4$) obtained by dividing the length (L) by the fourth power of the diameter (D).

The lower limit for the diameter (D) of about 9 mils (0.23 mm) is important for good yarn quality when spinning such filaments of about 5 dpf; capillaries of diameter 8 mils (0.2 mm) are not recommended because particles tend to plug the capillaries. Spinnerets of lower diameter, such as 8 mils (0.2 mm), may be used for filaments of lower dpf if solid particles are prevented from reaching the capillaries. One will generally prefer to use a low diameter within the practical range, e.g., a diameter of 9 to 11 mils (0.23–0.28 mm) for filaments of about 5 dpf, for practical reasons, since a larger diameter will require making a longer capillary, in order to keep the $L/D^4$ within the desired range. Thus the upper limit of diameter is chosen mainly for practical reasons, since a capillary of diameter 15 mils (0.38 mm) would require a length (L) of the order of a tenth of an inch (2.5 mm) or more.

The $L/D^4$ ratio is very important. Filaments of about 5 dpf were spun and wound with continuity and having only few broken filaments using a capillary of diameter 10 mils (0.25 mm) and $L/D^4$ $20\times10^{-4}$ mils$^{-3}$ (120 mm$^{-3}$) at 6700 yards per minute ($\approx$6100 meters/minute). These results were not as good as when a preferred capillary of $L/D^4$ $40\times10^{-4}$ mils$^{-3}$ (250 mm$^{-3}$) was used. When a capillary of diameter 9 mils (0.23 mm) and of $L/D^4$ $18\times10^{-4}$ mils$^{-3}$ (110 mm$^{-3}$) was used to spin at about 7000 ypm ($\approx$6400 mpm), yarn quality was poorer than that obtained with the above 10 mils (0.25 mm) capillaries of $L/D^4$ ratios $20\times10^{-4}$ mils$^{-3}$ (120 mm$^{-3}$) and $40\times10^{-4}$ mils$^{-3}$ (250 mm$^{-3}$). A higher range of $L/D^4$ is preferred for filaments of smaller dpf, because of the lower throughput, at the same speed. Although, as already indicated, several other conditions can affect continuity and yarn quality when spinning at these extremely high speeds, an $L/D^4$ ratio of at least $20\times10^{-4}$ mils$^{-3}$ (120 mm$^{-3}$) is preferred when spinning filaments of about 5 dpf. An upper $L/D^4$ limit of about $100\times10^{-4}$ mils$^{-3}$ (600 mm$^{-3}$), preferably about $70\times10^{-4}$ mils$^{-3}$ (425 mm$^{-3}$), is based on a desire to avoid excessive pack pressures. Lower values of $L/D^4$ within this range are generally preferred for practical reasons, i.e., to avoid making excessively long capillaries.

As will be seen hereinafter, a spinneret with an orifice capillary of 10 mils (D)$\times$40 mils (L) 0.25 mm$\times$1 mm is preferred for spinning filaments of about 5 dpf. Such capillary has an L:D ratio of 4:1. Preferably the L:D ratio is at least about 4:1. As this L:D ratio is reduced, the filaments may tend to be less uniform, because the melt has less time to achieve a steady state as it passes through the capillary.

It is surprising that continuity is improved and/or other advantages are obtained, by using a capillary of relatively small diameter and relatively large length at these very high speeds. One might have expected instead that the spinning of filaments of the same denier at higher spinning speeds would have been achieved more easily with orifices of larger diameter because of the need to increase the throughput of the extremely viscous polymer to an extent corresponding to the higher speed, and to avoid a problem referred to as "melt fracture" or "capillary break-up", whereby the polymer flow through the capillary lacks uniformity and eventually forms droplets instead of a continuous filament. Although the invention is not limited to any particular theory, it is considered that the value $L/D^4$ is significant because it is related to the pressure drop through the capillary, and the pressure drop is related to the work done by the viscous polymer melt as it passes through the capillary (causing a temperature rise near the wall of the capillary). A significant difference in temperature ($\Delta T$) between the exterior and the interior of the emerging melt is desirable to make the filaments of the invention.

This temperature difference $\Delta T$ may be estimated from theoretical considerations. It is found that the approximate temperature difference is 2° C. for a 20 mil (0.5 mm) diameter capillary with an $L/D^4$ ratio $5\times10^{-4}$ mils$^{-3}$ (c. 30 mm$^{-3}$) while a preferred spinneret with a 10 mil (0.25 mm) diameter and an $L/D^4$ ratio of $40\times10^{-4}$ mils$^{-3}$ (c. 250 mm$^{-3}$) has an approximate temperature difference of 9° C. At extremely high spinning speeds, a temperature difference of at least 5° C. is preferred when spinning with block temperatures less than about 310° C. For block temperatures more than about 310° C. it is observed that the spinning continuity and yarn quality become less sensitive to the capillary dimensions. To reduce the possibility of polymer degradation, however, block temperatures less than 310° C. are generally preferred, and so the use of a high shear (heat-generating) spinneret is preferred to obtain the surface temperature of about 305° C. to 330° C. that is believed to be desirable for continuity in spinning and better filament quality when spinning at extremely high speeds. Also is has been found that increasing the temperature ($T_s$) of the polymer at the wall of the capillary has a greater beneficial effect on skin-core at lower values of $T_s$ up to a preferred minimum $T_s$, and thereafter any further decrease in skin-core is generally less proportionately for a further increase in $T_s$. This preferred minimum $T_s$ increases with spinning speed.

The values herein have been obtained by working with filaments of 1 to 7 dpf. As indicated already, a change in dpf is important since this changes the throughput w. By using an average throughput value w, equivalent to that preferred for 4–7 dpf, namely 0.44 pounds of polymer/hour/capillary (ppH) (0.2 kg/hr/capillary), at block temperatures of less than about 310° C., the preferred $L/D^4$ limits of $20\times10^{-4}$ to $70\times10^{-4}$, generally up to $100\times10^{-4}$ mils$^{-3}$ (120 mm$^{-3}$ to 425 mm$^{-3}$, generally up to 600 mm$^{-3}$) convert to $Lw/D^4$ values of $9\times10^{-4}$ to $30\times10^{-4}$, generally up to $45\times10^{-4}$ ppH mils$^{-3}$ (25 to 85, generally up to 125$\times$mm$^{-3}$ kg/hr) the lower limiting value of which may depend to some extent on spinning speed, i.e., 8–9$\times10^{-4}$ ppH mils$^{-3}$ (25 mm$^{-3}$ kg/hr) giving satisfactory continuity and/or yarn quality at speeds such as 6000 yards per minute (about 5500 meters/minute), while being only borderline at greater speeds, where as $Lw/D^4$ values of $5\times10^{-4}$ ppH mils$^{-3}$ (15 mm$^{-3}$ kg/hr) give unsatisfactory results even at 6000 yards/minute (about 5500 meters/minute).

At block temperatures more than about 310° C., as indicated above, the need for shear heating is not as stringent so the preferred lower limits of $L/D^4$ may be $5\times10^{-4}$ mils$^{-3}$ (30 mm$^{-3}$) and of $Lw/D^4$ $2.5\times10^{-4}$ ppH mils$^{-3}$ ($7\times$mm$^{-3}$ kg/hr).

Spinnerets having orifice capillaries with small diameter, e.g., less than 15 mils (0.38 mm), have been suggested but it was not expected that use of such spinnerets within certain limits of $L/D^4$ could be advantageous under the conditions (especially of temperature and throughput w) indicated because these conditions are close to those that might have been expected to give melt fracture. Previously it was preferred to avoid operating near melt fracture conditions.

Another important feature is the treatment of the filaments as they emerge from the orifices. The prior art contains many suggestions for special devices to cool and solidify the freshly-extruded filament bundle or strand. As the speed of withdrawal has increased, the throughput of hot polymer has increased, and it has been thought important to increase the flow of cooling air, in order to obtain adequate cooling of this larger throughput. The most effective forced cooling device has been a forced flow of cross-flow air, i.e. a unidirectional stream of air passed across and through the filament strand. We have found, however, that at very high spinning speeds the amount of forced air should be reduced. When there is no flow of air the threadline is very unstable and the filaments frequently strike adjacent moving filaments and fuse and break. A slight flow of air causes a significant improvement in yarn quality. Increasing air flow rate further appears to make the threadline brittle since the frequency of broken filaments first increases sharply and then begins to level off and eventually decreases slightly at very high quench air flow rates. Thus, when spinning at extremely high speeds, as the quench air flow rate is increased, the number of broken filaments passes through a minimum (optimum) value, which is not usually observed at conventional spinning speeds, especially if the temperature has been properly chosen. At these extremely high speeds, it is preferred to delay cooling of the emerging filaments immediately below the spinneret. It is preferred to provide a zone in which protection is provided for the filaments and for the spinneret face from turbulent eddies. This can be achieved by a hollow tube surrounding the emerging filament strand in a known manner. Introduction of some gas, e.g. air, as a coolant below the spinneret is desirable to avoid turbulent conditions that would otherwise result from air being drawn up towards the face of the spinneret by the pumping action of the fastmoving filaments. Thus, it is advantageous to introduce gaseous coolant symmetrically, i.e. radially, around the filament strand below the protective tube, e.g., by using a foraminous tube and outer plenum chamber, preferably with a lower impervious tube also surrounding the filament strand, as suggested in Dauchert U.S. Pat. No. 3,067,458, and it is preferred to introduce sufficient gaseous coolant as to prevent such a significant amount of air from being pumped up into this tube zone as would cause turbulence. The amount of gaseous coolant that is introduced is much less than in prior art suggestions for forced cooling, being less than 4, preferably less than 3 scfm/pound of polymer throughput per hour (less than about 250, preferably less than about 190 liters/min/kg/hr); these amounts contrast with a flow of about 6 scfm/pound/hour (about 375 liters/min/kg/hr) for cooling commercial 150 denier equivalent polyester feed yarn for draw-texturing. The amount of gaseous coolant for forced cooling of low dpf yarns (e.g. less than about 4 dpf) is found to be less than 7 scfm/pound/hour (440 liters/min/kg/hr), preferably less than 6 scfm/pound/hour (375 liters/min/kg/hr); these amounts are greater than those used for high dpf yarns (>4 dpf) as described above; but contrast with a flow of about 8 to 10 scfm/pound/hour (500 to 625 liters/min/kg/hr) for cooling of commercial polyester draw-texturing feed yarns of equivalent dpf. Air is the preferred coolant because of its low cost, but inert coolants, such as nitrogen or inert gases may be preferred for some purposes. The coolant will generally be at ambient temperature, but it may sometimes be preferred to control the conditions, e.g. of temperature and humidity, and to introduce heated gas into this zone to further delay the cooling and solidification of the filaments as suggested in Chantry & Molini U.S. Pat. No. 3,216,187 and Cenzato U.S. Pat. No. 3,361,859. It will be understood that heating of cross-flow air is one way of improving the results of this system.

It is noted that at spinning speeds according to this invention threadline stability (absence of sideways motion) must be maintained to prevent the freshly extruded filaments from sticking together. Factors which reduce spinning stresses such as high polymer temperature and quench environment temperature tend to decrease threadline stability. At high polymer temperatures it may be necessary to decrease the length of the hollow metal tube and/or to allow for greater heat exchange through the tube. Under low-spinning-stress conditions it may even be necessary to use a greater flow (even more than 4 scfm/pph (250 liters/min/kg/hr) of quench gas to insure threadline stability.

After solidifying the filaments and combining them into a strand, and preferably after applying finish, we have sometimes found it helpful to deflect the strand around a guide 25, in its passage to the first driven roll 31. It is considered that such guide may control possible surges in tension that would otherwise be applied to the solidifying filaments as they are withdrawn from the spinneret.

The polymer should preferably be at a temperature below its glass transition temperature as it passes any tension-controlling device. Any tension-controlling device is preferably downstream from finish roll 20, whereby the finish helps to prevent filament abrasion and significant increase in temperature of the filaments from frictional causes at this location. In practice, the precise arrangement is achieved empirically according to the precise conditions of spinning. Although conventional pin guides have been used, other conventional guides could be used to act as a tension-controlling device, or alternative means can be used to control surges of tension on the filaments as they are withdrawn from the spinneret.

The terms *spinning speed* and *withdrawal speed* have been used herein to refer to the speed of the first driven roll wrapped (at least partially) by the filaments, i.e. feed roll 31 in FIG. 1 (not finish roll 20, which is merely kissed). The term spinning speed is used more frequently in the art, and is essentially similar to the winding speed (i.e. the speed at which the filaments are wound on a package) in the spinning stage of a split process or in a high-speed spinning process. In a coupled process, the winding speed is faster than the spinning speed, and so the term withdrawal speed has sometimes been referred to herein, so as to avoid confusion with the winding speed.

It will also be understood that additives such as pigments and delusterants may be incorporated in the filaments of the invention, and conventional aspects of polyester filament production, such as additives, have not been discussed herein.

The invention is further illustrated in the following Examples, which are for convenience presented mainly in the form of Tables showing the conditions of preparation and the properties of the yarns produced. Examples with a letter C (e.g., Example 2C) concern yarns with skin-core values above the line XYZ in FIG. 3, which is discussed after Example 44.

All the finishes are aqueous emulsions containing 8 to 10% by weight of non-aqueous ingredients, and are applied so as to provide 0.3 to 0.5% by weight of such ingredients on the weight of the yarn.

Finish 1 is as described in Example 1 of U.S. Pat. No. 3,859,122.

Finish 2 is based on Pluronic L-64 (BASF Wyandotte) (a polyoxyalkylene block copolymer of ethylene oxide and propylene oxide) with minor amounts of sodium dioctyl sulfosuccinate, buffering agents and antioxidants.

Finish 3 comprises:

27 parts ditridecyl adipate
12.3 parts polyoxyethylene(30)sorbitol tetrastearate
4.9 parts polyoxyethylene(20)sorbitan tristearate
5.0 parts isostearic acid
1.6 parts potassium hydroxide (45%)
50 parts of a block copolymer of ethylene oxide and propylene oxide (1:10 mole ratio) having a number average molecular weight of 1100
0.25 part tris(nonylphenyl)phosphite
0.25 part 4,4'-butylidene bis(6-t-metacresol)
0.3 part of a random copolymer of ethylene oxide and propylene oxide having a viscosity of 9150 SUS at 100° F.

EXAMPLES 1-29C

These Examples are presented in Table I. Molten poly(ethylene terephthalate), having an HRV of 22, and containing 0.3% by weight of $TiO_2$, is fed to a spinning machine, forced through a filter pack under the pressure shown in psig and extruded to form 34 filaments by using two adjacent spinnerets, each having 17 orifices, which filaments are cooled and wound up as a yarn of the indicated denier at the indicated speed using an apparatus essentially as shown in FIG. 1.

The orifices in each spinneret are located on two concentric circles with an orifice spacing of at least $\frac{1}{8}$ inch. The capillary dimensions and throughput of polymer per capillary are as shown, D for diameter and L for length in mils, and w (flow) in pph (pounds per hour). The $L/D^4$ and $wL/D^4$ values are shown in $10^{-4}\times mils^{-3}$, and $10^{-4}\times pph\ mils^{-3}$, respectively. All temperatures are given in °C. The polymer temperatures ($T_p$), in the filter pack at a point 50-100 mils above the center of the spinneret plate are calculated, except for Example 27, which was measured.

Each bundle of filaments is subjected to a transverse flow of air at room temperature (20° C.) and at the rate shown in standard cubic feet/minute for every pound per hour of bundle throughput (scfm/pph) before passing into the atmosphere. In Examples 1 to 15C and 19-24C the bundle is treated with cross-flow air through a foraminous screen extending over a length of 30 inches; in Examples 17-18 and 28-29C a similar cross-flow screen extends for 54 inches; in Examples 25 and 27 a similar 54 inch screen is used, but with a metal protective tube around the freshly-emerging filaments for a distance extending for the first 4 inches below the spinneret; and in Examples 16 and 26, radial systems are used as described and illustrated in FIG. 1, with a metal protective tube 3 of internal diameter $2\frac{3}{4}$ inches (and of length 3 inches in Example 16, but of length $3\frac{7}{8}$ inches in Example 26), below which is a further tube of diameter $2\frac{7}{8}$ inches and of length $12\frac{1}{2}$ inches, the upper 6 inch portion of which is foraminous and the lower $6\frac{1}{2}$ inch portion of which is impervious.

The filaments in each bundle converge at guide 21 and pass over roll 20 applying the finish shown. The two bundles pass further guides and are converged to a 34 filament yarn, which is wound up at the speed shown.

As-spun yarn characteristics are given in Table 1; the measurements have already been discussed. The long-period spacing (LPS) is over 300 Å for the as-spun filaments of the invention spun at speeds of 5500 to 7000 YPM, but has not always been measured. The SAXS pattern was not sufficiently discrete to permit a measurement of long-period spacing for Example 28, spun at 8000 yards/minute. It is doubted that the yarns of Examples 27-29C have long-period spacings over 300 Å. Preferred as-spun filaments have skin-core values that are significantly below line XYZ in FIG. 3, e.g., Example 12, whereas as-spun yarns having skin-core values that are above the line XYZ in FIG. 3 are for convenience marked with a C in the Table, e.g. Examples 14C and 15C. FIG. 3 is discussed in more detail after Example 44. All the filaments have large average crystal size (at least 55 Å) and low amorphous birefringence (less than 0.070) whether in as-spun or annealed condition.

EXAMPLES 30-35C

The process described in Example 26 was essentially followed, except that the rate of flow of air was varied when spinning at 6000 yards/minute (30-32) and 7000 yards/minute (33-35C). The actual process conditions and yarn characteristics are given in Table II. It will be noted that the skin-core values increase with an increasing rate of flow of air when spinning at 7000 yards/minute, whereas the skin-core values are essentially similar at 6000 yards/minute, regardless of a variation in the air flow over a range of 0.8 to 3.8 scfm/pph. The long-period spacing of the yarn of Example 34 is 320 Å; although the other long-period spacing measurements were not made for these Examples, enough other values have been measured to establish that filaments spun at these high speeds (6000 and 7000 yards/minute) do have long-period spacing of over 300 Å.

EXAMPLES 36-39

The process described in Examples 17-18 was essentially followed (at 7000 yards/minute) while varying the block temperature, the capillary dimensions and the flow of air, the values being given in Table III; the polymer temperatures ($T_p$) were measured in Examples 36 and 37. It will be noted that preferred low skin-core values are obtained in Example 37 with a high shear spinneret, a low block temperature and low air flow, and in Example 39 with a low shear spinneret, high block temperature and high air flow, the $\sigma_{20}$ values being somewhat different. By increasing the air flow with the high shear spinneret in Example 36 (to the same rate as in Example 39) or by using a slightly lower block temperature (305° C., which is still high) with the low shear spinneret in Example 38C, the skin-core values were raised significantly.

EXAMPLES 40C–44

All these Examples were run at 7000 yards/minute, the conditions and yarn characteristics being given in Table IV, and show the effect on skin-core value of spinning filaments of lower denier per filament (dpf), i.e., of lowering the capillary throughput (w). Example 41 is the same as Example 34 and should be contrasted with Example 40C, run under similar conditions, including the same volume flow of air, but lower polymer throughput, consequently lower denier and lower polymer temperature, and the skin-core value is higher. It is preferred, therefore, to raise the polymer temperature and use a higher shear capillary spinneret (10×80 mil) as in Examples 42–44, which are otherwise run essentially as in Example 25, with varying pack pressures, and so formed filaments of even lower dpf and of low skin-core value. The polymer temperatures ($T_p$) were measured in Examples 42 and 44.

As indicated above, a general correlation has been noted between high skin-core values and continuity problems in spinning, especially as the speed is increased to about 7000 yards/minute. Thus it was not possible to wind yarn in Examples 22C, 23C or 24C, and only feed roll wraps were obtained, in contrast to Examples 20C and 21, where good continuity was achieved for several minutes, but the objective of winding a package for a full 40 minutes was not reliably obtained, Example 19 where the continuity in spinning was better and averaged 15 minutes, and Example 16, where excellent continuity in winding yarn packages was achieved. As indicated hereinafter, although spinning continuity was obtained to some extent in Example 20C, the resulting yarns presented problems in draw-texturing. Some continuity problems have, however, been traced to other factors, e.g., apparatus features.

Table I

| Example | 1 | 2C | 3 |
|---|---|---|---|
| Spin. Speed, YPM | 5500 | 5500 | 5500 |
| Orifice (D × L), mils | 10×40 | 20×80 | 15×60 |
| $\frac{L}{D^4}$, $10^{-4}$ mils$^{-3}$ | 40 | 5 | 12 |
| Flow (w) pph/cap | .365 | .377 | .390 |
| $\frac{wL}{D^4}$, $10^{-4}$ pph mils$^{-3}$ | 14.60 | 1.89 | 4.62 |
| Block Temp. $T_B$ °C. | 297 | 298 | 297 |
| Pack Press. psig | 5250 | 3150 | 3700 |
| Poly. Temp. $T_p$(°C.) | 299 | 299 | 298 |
| Air, scfm/pph | 3.2 | 3.2 | 3.2 |
| Finish Type | 1 | 2 | 2 |
| Denier | 168 | 174 | 180 |
| Init. Mod. gpd | 60.8 | 66.1 | 63.0 |
| $\sigma_{20}$, gpd | 1.61 | 1.64 | 1.60 |
| Tenacity, gpd | 3.47 | 3.34 | 3.52 |
| Elong. % | 62.1 | 59.1 | 65.3 |
| BOS, % | 3.3 | 3.0 | 3.2 |
| DHS, 160° C., % | 3.7 | 3.0 | 3.2 |
| Max. Sh. Tens. gpd | .101 | .095 | .093 |
| Density ($\rho$), g/cc | 1.3700 | 1.3766 | 1.3736 |
| $V_s$, km/sec | 2.72 | 3.06 | 2.66 |
| $T_{melt}$, °C. | 258 | 257 | 258 |
| $\pi°$, | 16 | 15 | 18 |
| CS, Å | 61 | 65 | 55 |
| LPS, Å | 313 | — | — |
| $\Delta_5$ | .0958 | .0965 | .0959 |
| $\Delta_{95-5}$ | .0077 | .0082 | .0069 |

Table I-continued

| | | | |
|---|---|---|---|
| $\Delta_c$ | .201 | .206 | .198 |
| $\Delta_{am}$ | .045 | .038 | .046 |
| RDDR, % dye/min ½ | .065 | .077 | .070 |

| Example | 4 | 5 | 6 | 7 |
|---|---|---|---|---|
| Spin. Speed, YPM | 6000 | 6000 | 6000 | 6000 |
| Orifice (D × L), mils | 10×40 | 10×40 | 9×36 | 10×20 |
| $\frac{L}{D^4}$, $10^{-4}$ mils$^{-3}$ | 40 | 40 | 55 | 20 |
| Flow (w) pph/cap | .462 | .400 | .391 | .404 |
| $\frac{wL}{D^4}$, $10^{-4}$ pph mils$^{-3}$ | 18.48 | 16.00 | 21.47 | 8.08 |
| Block Temp. $T_B$ °C. | 294 | 297 | 296 | 293 |
| Pack Press. psig | 4500 | 4900 | 5100 | 3700 |
| Poly. Temp. $T_p$ (°C.) | 297 | 299 | 299 | 296 |
| Air, scfm/pph | 2.9 | 2.9 | 2.9 | 2.1 |
| Finish Type | 1 | 2 | 2 | 1 |
| Denier | 194 | 169 | 165 | 171 |
| Init. Mod. gpd | 79.4 | 71.6 | 69.2 | 67.8 |
| $\sigma_{20}$, gpd | 1.89 | 2.01 | 1.99 | 1.99 |
| Tenacity, gpd | 3.76 | 3.61 | 3.72 | 3.75 |
| Elong. % | 57.6 | 52.9 | 53.1 | 53.5 |
| BOS, % | 3.6 | 3.7 | 2.8 | 2.8 |
| DHS, 160° C., % | 3.6 | 3.6 | 3.4 | 3.0 |
| Max. Sh. Tens. gpd | .109 | .116 | .114 | .109 |
| Density ($\rho$), g/cc | 1.3810 | 1.3770 | 1.3781 | 1.3801 |
| $V_s$, km/sec | 2.70 | 2.91 | 2.86 | 2.51 |
| $T_{melt}$, °C. | 258 | 259 | 259 | 257 |
| $\pi°$, | 11 | 16 | 14 | 11 |
| CS, Å | 73 | 73 | 61 | 73 |
| LPS, Å | 374 | 329 | — | — |
| $\Delta_5$ | .1078 | .1082 | .1077 | .1064 |
| $\Delta_{95-5}$ | .0080 | .0066 | .0073 | .0074 |
| $\Delta_c$ | .206 | .201 | .203 | .206 |
| $\Delta_{am}$ | .047 | .057 | .055 | .047 |
| RDDR, % dye/min ½ | .073 | .060 | .065 | .068 |

| Example | 8C | 9C | 10C | 11 |
|---|---|---|---|---|
| Spin. Speed, YPM | 6000 | 6000 | 6000 | 6000 |
| Orifice (D × L), mils | 20×80 | 20×80 | 15×60 | 15×60 |
| $\frac{L}{D^4}$, $10^{-4}$ mils$^{-3}$ | 5 | 5 | 12 | 12 |
| Flow (w) pph/cap | .407 | .405 | .406 | .429 |
| $\frac{wL}{D^4}$, $10^{-4}$ pph mils$^{-3}$ | 2.04 | 2.03 | 4.81 | 5.08 |
| Block Temp. $T_B$ °C. | 296 | 300 | 293 | 300 |
| Pack Press. psig | 3200 | 3350 | 4300 | 3800 |
| Poly. Temp. $T_p$ (°C.) | 298 | 301 | 296 | 301 |
| Air, scfm/pph | 2.9 | 2.1 | 2.9 | 2.1 |
| Finish Type | 2 | 2 | 2 | 2 |
| Denier | 171 | 170 | 172 | 182 |
| Init. Mod. gpd | 82.3 | 76.0 | 56.6 | 75.4 |
| $\sigma_{20}$, gpd | 1.91 | 1.97 | 1.89 | 1.94 |
| Tenacity, gpd | 3.48 | 3.57 | 3.67 | 3.87 |
| Elong. % | 53.8 | 53.6 | 54.0 | 58.7 |
| BOS, % | 3.9 | 2.8 | 3.3 | 3.1 |
| DHS, 160° C., % | 4.2 | 2.8 | 3.3 | 2.8 |
| Max. Sh. Tens. gpd | .180 | .122 | .122 | .109 |
| Density ($\rho$), g/cc | 1.3829 | 1.3789 | 1.3802 | 1.3796 |
| $V_s$, km/sec | 2.86 | 3.02 | 2.86 | 2.51 |
| $T_{melt}$, °C. | 258 | 261 | 261 | 261 |
| $\pi°$, | 13 | 16 | 12 | 15 |
| CS, Å | 74 | 67 | 75 | 65 |
| LPS, Å | — | 403 | — | — |
| $\Delta_5$ | .1021 | .1065 | .1044 | .1089 |
| $\Delta_{95-5}$ | .0106 | .0083 | .0085 | .0080 |
| $\Delta_c$ | .205 | .201 | .205 | .202 |
| $\Delta_{am}$ | .034 | .045 | .053 | .053 |
| RDDR, % dye/min ½ | .071 | .072 | .063 | .068 |

| Example | 12 | 13 | 14C | 15C |
|---|---|---|---|---|
| Spin. Speed, YPM | 6500 | 6500 | 6500 | 6500 |
| Orifice (D × L), mils | 10×40 | 9×36 | 20×80 | 15×60 |
| $\frac{L}{D^4}$, $10^{-4}$ mils$^{-3}$ | 40 | 55 | 5 | 12 |
| Flow (w) pph/cap | .419 | .412 | .417 | .435 |
| $\frac{wL}{D^4}$, $10^{-4}$ pph mils$^{-3}$ | 16.76 | 22.62 | 2.09 | 5.15 |

Table I-continued

| | | | | |
|---|---|---|---|---|
| Block Temp. $T_B$ °C. | 298 | 299 | 302 | 302 |
| Pack Press. psig | 4850 | 5200 | 3725 | 4000 |
| Poly. Temp. $T_p$ (°C.) | 300 | 301 | 303 | 303 |
| Air, scfm/pph | 2.8 | 2.8 | ~1.3 | 2.1 |
| Finish Type | 2 | 2 | 2 | 2 |
| Denier | 165 | 161 | 163 | 170 |
| Init. Mod. gpd | 76.1 | 75.4 | 92.5 | 91.0 |
| $\sigma_{20}$, gpd | 2.41 | 2.31 | 2.29 | 2.17 |
| Tenacity, gpd | 3.88 | 3.95 | 3.72 | 3.82 |
| Elong. % | 47.2 | 48.2 | 47.6 | 48.0 |
| BOS, % | 3.1 | 2.5 | 2.4 | 2.6 |
| DHS, 160° C., % | 3.3 | 3.2 | 2.4 | 2.6 |
| Max. Sh. Tens. gpd | .129 | .149 | .128 | .132 |
| Density ($\rho$), g/cc | 1.3887 | 1.3844 | 1.3852 | 1.3857 |
| $V_s$, km/sec | 2.98 | 3.07 | 3.05 | 3.02 |
| $T_{melt}$, °C. | 263 | 263 | 264 | 263 |
| $\pi°$, | 14 | 14 | 15 | 14 |
| CS, Å | 72 | 72 | 64 | 66 |
| LPS, Å | 325 | 390 | — | 440 |
| $\Delta_5$ | .1153 | .1147 | .1109 | .1115 |
| $\Delta_{95\text{-}5}$ | .0064 | .0079 | .0095 | .0099 |
| $\Delta_c$ | .203 | .203 | .206 | .203 |
| $\Delta_{am}$ | .054 | .043 | .043 | .045 |
| RDDR, % dye/min ½ | .060 | .065 | .070 | .062 |

| Example | 16 | 17 | 18 | 19 |
|---|---|---|---|---|
| Spin. Speed, YPM | 7000 | 7000 | 7000 | 7000 |
| Orifice (D × L), mils | 10×40 | 10×40 | 10×20 | 10×40 |
| $\frac{L}{D^4}$, $10^{-4}$ mils$^{-3}$ | 40 | 40 | 20 | 40 |
| Flow (w) pph/cap | .439 | .449 | .442 | .471 |
| $\frac{wL}{D^4}$, $10^{-4}$ pph mils$^{-3}$ | 17.56 | 17.96 | 8.84 | 18.84 |
| Block Temp. $T_B$ °C. | 300 | 315 | 314 | 300 |
| Pack Press. psig | 5300 | 5600 | 4700 | 5300 |
| Poly. Temp. $T_p$ (°C.) | 302 | 313 | 312 | 302 |
| Air, scfm/pph | 2.5 | 2.7 | 2.8 | 2.0 |
| Finish Type | 2 | 3 | 3 | 2 |
| Denier | 163 | 162 | 160 | 163 |
| Init. Mod. gpd | 78.9 | 90.9 | 90.8 | 87.3 |
| $\sigma_{20}$, gpd | 2.88 | 2.96 | 2.99 | 2.74 |
| Tenacity, gpd | 4.32 | 4.33 | 4.48 | 4.02 |
| Elong. % | 45.0 | 42.7 | 45.9 | 43.5 |
| BOS, % | 1.8 | 2.4 | 2.5 | 2.5 |
| DHS, 160° C., % | 2.9 | 3.1 | 3.0 | 3.7 |
| Max. Sh. Tens. gpd | .123 | .120 | .144 | .128 |
| Density ($\rho$), g/cc | 1.3875 | 1.3868 | 1.3870 | 1.3860 |
| $V_s$, km/sec | 3.34 | 3.22 | 3.15 | 3.12 |
| $T_{melt}$, °C. | 263 | 261 | 259 | 261 |
| $\pi°$, | 14 | 12 | 11 | 11 |
| CS, Å | 71 | 68 | 72 | 73 |
| LPS, Å | 350 | 330 | — | 370 |
| $\Delta_5$ | .1233 | .1241 | .1229 | .1174 |
| $\Delta_{95\text{-}5}$ | .0073 | .0074 | .0084 | .0072 |
| $\Delta_c$ | .203 | .205 | .207 | .207 |
| $\Delta_{am}$ | .061 | .063 | .059 | .051 |
| RDDR, % dye/min ½ | .059 | .049 | .055 | .057 |

| Example | 20C | 21 | 22C | 23C |
|---|---|---|---|---|
| Spin. Speed, YPM | 7000 | 7000 | 7000 | 7000 |
| Orifice (D × L), mils | 10×40 | 9×36 | 20 ×80 | 15×60 |
| $\frac{L}{D^4}$, $10^{-4}$ mils$^{-3}$ | 40 | 55 | 5 | 12 |
| Flow (w) pph/cap | .447 | .455 | .394 | .437 |
| $\frac{wL}{D^4}$, $10^{-4}$ pph mils$^{-3}$ | 17.88 | 24.98 | 1.97 | 5.18 |
| Block Temp. $T_B$ °C. | 295 | 300 | 302 | 296 |
| Pack Press. psig | 4900 | 5900 | 3800 | 4100 |
| Poly. Temp. $T_p$ (°C.) | 298 | 302 | 303 | 298 |
| Air, scfm/pph | 2.0 | 2.0 | <1.3 | 2.7 |
| Finish Type | 2 | 2 | 2 | 2 |
| Denier | 171 | 162 | 143 | 159 |
| Init. Mod. gpd | 84.7 | 90.0 | 85.3 | 81.4 |
| $\sigma_{20}$, gpd | 2.68 | 2.77 | 2.33 | 2.51 |
| Tenacity, gpd | 3.97 | 3.92 | 3.53 | 3.75 |
| Elong. % | 43.3 | 39.7 | 45.4 | 40.7 |
| BOS, % | 2.4 | 2.5 | 2.2 | 2.8 |
| DHS, 160° C., % | 3.0 | 3.0 | 2.8 | 3.0 |
| Max. Sh. Tens. gpd | .137 | .130 | .112 | .145 |

Table I-continued

| | | | | |
|---|---|---|---|---|
| Density ($\rho$), g/cc | 1.3859 | 1.3873 | 1.3871 | 1.3844 |
| $V_s$, km/sec | 3.23 | 3.23 | 3.18 | 3.20 |
| $T_{melt}$, °C. | 263 | 264 | 265 | 267 |
| $\pi°$, | 15 | 22 | 13 | 10 |
| CS, Å | 69 | 72 | 74 | 57 |
| LPS, Å | 355 | 450 | 390 | 49 |
| $\Delta_5$ | .1111 | .1168 | .1098 | .1064 |
| $\Delta_{95\text{-}5}$ | .0108 | .0092 | .0110 | .0163 |
| $\Delta_c$ | .202 | .193 | .204 | .208 |
| $\Delta_{am}$ | .043 | .060 | .037 | .035 |
| RDDR, % dye/min ½ | .062 | .053 | — | .067 |

| Example | 24C | 25 | 26 |
|---|---|---|---|
| Spin. Speed, YPM | 7000 | 7000 | 7000 |
| Orifice (D × L), mils | 15×60 | 15×60 | 10×40 |
| $\frac{L}{D^4}$, $10^{-4}$ mils$^{-3}$ | 12 | 12 | 40 |
| Flow (w) pph/cap | .437 | .438 | .440 |
| $\frac{wL}{D^4}$, $10^{-4}$ pph mils$^{-3}$ | 5.18 | 5.19 | 17.60 |
| Block Temp. $T_B$ °C. | 302 | 315 | 302 |
| Pack Press. psig | 4200 | 5800 | 4800 |
| Poly. Temp. $T_p$ (°C.) | 303 | 314 | 303 |
| Air, scfm/pph | <1.3 | 2.8 | 1.2 |
| Finish Type | 2 | 3 | 3 |
| Denier | 160 | 158 | 159 |
| Init. Mod. gpd | 94.4 | 92.0 | 126.4 |
| $\sigma_{20}$, gpd | 2.77 | 3.02 | 2.71 |
| Tenacity, gpd | 3.72 | 4.41 | 4.27 |
| Elong. % | 40.6 | 44.1 | 47.9 |
| BOS, % | 2.8 | 2.6 | 2.5 |
| DHS, 160° C., % | 2.5 | 3.0 | 3.0 |
| Max. Sh. Tens. gpd | .134 | .148 | .138 |
| Density ($\rho$), g/cc | 1.3845 | 1.3871 | 1.3857 |
| $V_s$, km/sec | 3.20 | 3.16 | 3.15 |
| $T_{melt}$, °C. | 265 | 260 | 257 |
| $\pi°$, | 18 | 13 | 13 |
| CS, Å | 70 | 68 | 71 |
| LPS, Å | — | 350 | — |
| $\Delta_5$ | .1149 | .1241 | .1237 |
| $\Delta_{99\text{-}5}$ | .0174 | .0074 | .0070 |
| $\Delta_c$ | .198 | .204 | .205 |
| $\Delta_{am}$ | .056 | .063 | .056 |
| RDDR, % dye/min ½ | — | .050 | .053 |

| Example | 27 | 28 | 29C |
|---|---|---|---|
| Spin. Speed. YPM | 7500 | 8000 | 8000 |
| Orifice (D × L), mils | 10×60 | 10×60 | 10×20 |
| $\frac{L}{D^4}$, $10^{-4}$ mils$^{-3}$ | 60 | 60 | 20 |
| Flow (w) pph/cap | .471 | .513 | .511 |
| $\frac{wL}{D^4}$, $10^{-4}$ pph mils$^{-3}$ | 28.26 | 30.78 | 10.22 |
| Block Temp. $T_B$ °C. | 315 | 315 | 315 |
| Pack Press. psig | 6500 | 7100 | 7100 |
| Poly. Temp. $T_p$ (°C.) | 313 | 311 | 316 |
| Air, scfm/pph | 2.6 | 2.4 | 2.4 |
| Finish Type | 3 | 3 | 3 |
| Denier | 159 | 162 | 161 |
| Init. Mod. gpd | 93.8 | 106.6 | 101.0 |
| $\sigma_{20}$, gpd | 3.32 | 3.49 | 3.46 |
| Tenacity, gpd | 4.33 | 4.12 | 4.01 |
| Elong. % | 35.2 | 31.8 | 30.2 |
| BOS, % | 2.1 | 2.0 | 2.0 |
| DHS, 160° C., % | 2.7 | 2.5 | 2.6 |
| Max. Sh. Tens. gpd | .155 | .186 | .173 |
| Density ($\rho$), g/cc | 1.3901 | 1.3870 | 1.3898 |
| $V_s$, km/sec | 3.24 | 3.56 | 3.50 |
| $T_{melt}$, °C. | 264 | 265 | 264 |
| $\pi°$, | 12.5 | 12 | 11 |
| CS, Å | 70 | 72 | 71 |
| LPS, Å | — | N | — |
| $\Delta_5$ | .1253 | .1227 | .1210 |
| $\Delta_{95\text{-}5}$ | .0095 | .0115 | .0139 |
| $\Delta_c$ | .205 | .205 | .207 |
| $\Delta_{am}$ | .058 | .060 | .049 |
| RDDR, % dye/min ½ | .052 | .057 | .056 |

TABLE II

| Example | 30 | 31 | 32 |
|---|---|---|---|
| Spin. Speed, YPM | 6000 | 6000 | 6000 |
| Orifice (D × L), mils | 10 × 40 | 10 × 40 | 10 × 40 |
| $\frac{L}{D^4}$, $10^{-4}$ mils$^{-3}$ | 40 | 40 | 40 |
| Flow (w) pph/cap | 0.390 | 0.391 | 0.392 |
| $\frac{wL}{D^4}$, $10^{-4}$ pph mils$^{-3}$ | 15.60 | 15.64 | 15.68 |
| Block Temp. $T_B$ °C. | 300 | 300 | 300 |
| Pack Press. psig | 4300 | 4300 | 4300 |
| Poly. Temp. $T_p$ (°C.) | 301 | 301 | 301 |
| Air, scfm/pph | 0.8 | 2.7 | 3.8 |
| Finish Type | 3 | 3 | 3 |
| Denier | 165 | 165 | 165 |
| Init. Mod. gpd | 104.9 | 100.0 | 104.4 |
| $\sigma_{20}$, gpd | 2.09 | 2.04 | 1.98 |
| Tenacity, gpd | 3.99 | 4.02 | 4.00 |
| Elong. % | 55.2 | 57.9 | 58.9 |
| BOS, % | 3.2 | 3.2 | 3.2 |
| DHS, 160° C., % | 3.9 | 3.9 | 3.7 |
| Max. Sh. Tens. gpd | .104 | .109 | .101 |
| Density (ρ), g/cc | 1.3766 | 1.3735 | 1.3747 |
| $V_s$, km/sec | 2.84 | 2.77 | 2.77 |
| $T_{melt}$, °C. | 253 | 258 | 254 |
| $\pi°$, | 12.5 | 12 | 14 |
| CS, Å | 72 | 72 | 60 |
| LPS, Å | — | — | — |
| $\Delta_5$ | .1099 | .1075 | .1075 |
| $\Delta_{95\text{-}5}$ | .0068 | .0069 | .0064 |
| $\Delta_c$ | .205 | .205 | .203 |
| $\Delta_{am}$ | .059 | .061 | .060 |
| RDDR, % dye/min ½ | .057 | .055 | .057 |

| Example | 33 | 34 | 35C |
|---|---|---|---|
| Spin. Speed, YPM | 7000 | 7000 | 7000 |
| Orifice (D × L), mils | 10 × 40 | 10 × 40 | 10 × 40 |
| $\frac{L}{D^4}$, $10^{-4}$ mils$^{-3}$ | 40 | 40 | 40 |
| Flow (w) pph/cap | 0.441 | 0.438 | 0.442 |
| $\frac{wL}{D^4}$, $10^{-4}$ pph mils$^{-3}$ | 17.64 | 17.52 | 17.68 |
| Block Temp. $T_B$ °C. | 302 | 302 | 302 |
| Pack Press. psig | 4800 | 4900 | 5100 |
| Poly. Temp. $T_p$ (°C.) | 303 | 303 | 303 |
| Air, scfm/pph | 0.7 | 2.4 | 3.3 |
| Finish Type | 3 | 3 | 3 |
| Denier | 159 | 158 | 160 |
| Init. Mod. gpd | 137.9 | 120.4 | 124.1 |
| $\sigma_{20}$, gpd | 2.78 | 2.72 | 2.59 |
| Tenacity, gpd | 4.36 | 4.46 | 4.06 |

TABLE II-continued

| | | | |
|---|---|---|---|
| Elong. % | 47.3 | 51.7 | 46.5 |
| BOS, % | 2.6 | 2.5 | 2.4 |
| DHS, 160° C., % | 3.3 | 3.0 | 2.8 |
| Max. Sh. Tens. gpd | .146 | .137 | .135 |
| Density (ρ), g/cc | 1.3844 | 1.3851 | 1.3841 |
| $V_s$, km/sec | 3.14 | 3.10 | 3.05 |
| $T_{melt}$, °C. | 257 | 257 | 258 |
| $\pi°$, | 13.5 | 12.5 | 11 |
| CS, Å | 66 | 72 | 74 |
| LPS, Å | — | — | — |
| $\Delta_5$ | .1230 | .1191 | .1170 |
| $\Delta_{95\text{-}5}$ | .0070 | .0087 | .0098 |
| $\Delta_c$ | .203 | .205 | .207 |
| $\Delta_{am}$ | .056 | .056 | .057 |
| RDDR, % dye/min ½ | .053 | .053 | .060 |

TABLE III

| Example | 36 | 37 | 38C | 39 |
|---|---|---|---|---|
| Spin. Speed, YPM | 7000 | 7000 | 7000 | 7000 |
| Orifice (D×L), mils | 10 × 80 | 10 × 80 | 9 × 12 | 9 × 12 |
| $\frac{L}{D^4}$, $10^{-4}$ mils$^{-3}$ | 80 | 80 | 18.3 | 18.3 |
| Flow (w) pph/cap | .423 | .442 | .442 | .434 |
| $\frac{wL}{D^4}$, $10^{-4}$ pph mils$^{-3}$ | 33.84 | 35.39 | 8.09 | 7.94 |
| Block Temp. $T_B$ °C. | 315 | 290 | 305 | 315 |
| Pack Press. psig | 5300 | 7150 | 4500 | 3500 |
| Poly. Temp. $T_p$ (°C.) | 315 | 295 | 306 | 314 |
| Air, scfm/pph | 7.0 | 2.8 | 4.8 | 7.0 |
| Finish Type | 3 | 3 | 3 | 3 |
| Denier | 153 | 166 | 160 | 157 |
| Init. Mod. gpd | 92.1 | 94.3 | 99.0 | 95.1 |
| $\sigma_{20}$, gpd | 2.99 | 2.89 | 3.03 | 3.01 |
| Tenacity, gpd | 4.41 | 3.91 | 4.44 | 4.37 |
| Elong. % | 44.1 | 36.8 | 43.4 | 42.3 |
| BOS, % | 2.7 | 2.5 | 2.4 | 2.4 |
| DHS, 160° C., % | 3.1 | 2.8 | 3.0 | 2.8 |
| Max. Sh. Tens. gpd | .157 | .157 | .168 | .171 |
| Density (ρ), g/cc | 1.3835 | 1.3872 | 1.3851 | 1.3855 |
| $V_s$, km/sec | 3.15 | 3.10 | 3.26 | 3.10 |
| $T_{melt}$, °C. | 258 | 260 | 259 | 259 |
| $\pi°$, | 18 | 13 | 15 | 15 |
| CS, Å | 64 | 72 | 66 | 72 |
| LPS, Å | — | — | — | — |
| $\Delta_5$ | .1236 | .1237 | .1217 | .1243 |
| $\Delta_{95\text{-}5}$ | .0093 | .0075 | .0100 | .0076 |
| $\Delta_c$ | .198 | .204 | .202 | .202 |
| $\Delta_{am}$ | .073 | .062 | .064 | .068 |
| RDDR, % dye/min ½ | .049 | .057 | .054 | .050 |

TABLE IV

| Example | 40C | 41 | 42 | 43 | 44 |
|---|---|---|---|---|---|
| Spin. Speed, YPM | 7000 | 7000 | 7000 | 7000 | 7000 |
| Orifice (D×L), mils | 10 × 40 | 10 × 40 | 10 × 80 | 10 × 80 | 10 × 80 |
| $\frac{L}{D^4}$, $10^{-4}$ mils$^{-3}$ | 40 | 40 | 80 | 80 | 80 |
| Flow (w) pph/cap | .331 | .438 | .276 | .355 | .433 |
| $\frac{wL}{D^4}$, $10^{-4}$ pph mils$^{-3}$ | 13.24 | 17.52 | 22.08 | 28.4 | 35.44 |
| Block Temp. $T_B$ °C. | 302 | 302 | 315 | 315 | 315 |
| Pack Press. psig | 3600 | 4900 | 5500 | 6200 | 7000 |
| Poly. Temp. $T_p$ (°C.) | 301 | 303 | 310 | 312 | 317 |
| Air, scfm/pph | 3.2 | 2.4 | 2.9 | 2.2 | 2.8 |
| Finish Type | 3 | 3 | 3 | 3 | 3 |
| Denier | 120 | 158 | 100 | 128 | 160 |
| Init. Mod. gpd | 89.1 | 120.4 | 88.1 | 90.7 | 86.7 |
| $\sigma_{20}$, gpd | 2.80 | 2.72 | 2.90 | 2.93 | 3.03 |
| Tenacity, gpd | 4.03 | 4.46 | 4.18 | 4.38 | 4.57 |
| Elong. % | 41.2 | 51.7 | 42.2 | 45.1 | 45.2 |
| BOS, % | 2.8 | 2.5 | 2.3 | 2.4 | 2.5 |
| DHS, 160° C., % | 3.3 | 3.0 | 3.0 | 3.0 | 3.1 |
| Max. Sh. Tens. gpd | .203 | .137 | .157 | .149 | .149 |
| Density (ρ), g/cc | 1.3867 | 1.3851 | 1.3867 | 1.3865 | 1.3875 |
| $V_s$, km/sec | 3.12 | 3.10 | 3.07 | 3.37 | 3.70 |
| $T_{melt}$, °C. | 261 | 257 | 260 | 262 | 261 |
| $\pi°$, | 12 | 13 | 12 | 13 | 13 |

TABLE IV-continued

| Example | 40C | 41 | 42 | 43 | 44 |
|---|---|---|---|---|---|
| CS, Å | 75 | 72 | 70 | 71 | 74 |
| LPS, Å | 350 | 320 | — | 350 | 320 |
| $\Delta_5$ | .1174 | .1191 | .1182 | .1218 | .1231 |
| $\Delta_{95-5}$ | .0104 | .0087 | .0078 | .0075 | .0070 |
| $\Delta_c$ | .205 | .205 | .205 | .205 | .205 |
| $\Delta_{am}$ | .051 | .056 | .052 | .059 | .059 |
| RDDR, % dye/min ½ | .056 | .053 | .046 | .051 | .054 |

FIG. 3 has been prepared to illustrate the relationship of the skin-core ($\Delta_{95-5}$) to the $\sigma_{20}$ values for the as-spun filaments prepared in the foregoing Examples, except for the following, which have been omitted from FIG. 3 because the points would have been so close to other points; Examples 7, 31 and 32, in the region of Examples 5 and 6; Example 26, close to Example 19; Examples 37 and 43, in the region of Examples 16, 17 and 42; Example 41, in the region of Examples 21 and 34; and Examples 39 and 44, close to Example 25. The line XP is defined by the equation used herein:

$$\Delta_{95-5}=0.0055+0.0014\sigma_{20}$$

Examples with a "C", e.g. 2C, have skin-core values above this line. For as-spun filaments of $\sigma_{20}$ above about 3, the line YZ is defined by the equation used herein:

$$\Delta_{95-5}=0.0065\sigma_{20}-0.0100$$

The skin-core values of Examples 38 C and 29 C that were spun at 7000 and 8000 ypm, respectively, are also above the line XYZ, which is a mathematical approximation of a concave (upward) curve, i.e., the upward slope increases more rapidly when $\sigma_{20}$ rises above about 3 gpd. These "C Examples" produce significantly more broken filaments or other defects during spinning (especially those at higher $\sigma_{20}$ values) and/or during subsequent textile processing than the preferred filaments of the invention that have skin-core values significantly below line XYZ, and generally have poorer tensile properties than such preferred filaments. Filaments having skin-core values in the neighborhood of line XYZ are borderline and do not generally perform so well as the preferred filaments, especially during draw-texturing. It is considered, however, that, even in the borderline area, over a prolonged period of time, as occurs when spinning millions of pounds of polymer commercially, less filament breaks will occur during spinning and/or subsequent processing with filaments having lower skin-core values than with filaments having higher skin-core values although no significant difference may be apparent from their filament properties, such as tensile properties and shrinkage properties.

The line XYZ has been selected empirically from a study of many samples, based on sensitivity of skin-core value to processing variables, in particular capillary dimensions and polymer temperature.

From a filament-processing standpoint, it is preferred to keep the skin-core value low in absolute terms, preferably below about 0.008, regardless of spinning speed and $\sigma_{20}$. From a practical standpoint, however, it becomes increasingly difficult to control the spinning conditions as the spinning speed increases, so it may be more practical to compromise with a higher skin-core value as the $\sigma_{20}$ value increases.

Various areas below the line XYZ have been roughly apportioned according to their approximate $\sigma_{20}$ value. Thus any prior art filaments in Area A would have $\sigma_{20}<1.6$ gpd and would have been spun at lower withdrawal speeds, e.g. 3500 ypm for spinning partially oriented draw-texturing feed yarn. The filaments in Area B have $1.6<\sigma_{20}<2$ gpd and were spun at relatively low speeds within the range of extremely high speeds that are used to get filaments of the invention. The filaments in Area C have $2<\sigma_{20}<2.6$ gpd and the advantage of a low skin-core value is more pronounced than in Area B. The filaments in Area D have $2.6<\sigma_{20}<3$ and are "hard" as defined herein, i.e. can be subjected (without deformation) to much greater stress than is desirable for filaments in Area C or especially in Area B, although it should be understood that all these filaments of the invention are suitable for some end uses without further drawing. The filaments in Area E may be under line YZ, rather than YP, it being understood that the line XYZ is actually a mathematical approximation of a concave (upward) curve and that it is preferred to have skin-core values that are significantly below the curve, and not in the borderline area.

As the $\sigma_{20}$ and spinning speed increase, the dyeability of the as-spun filaments generally decreases and of any draw-textured filaments generally increases, although the conditions of preparation of the feed yarns can have a significant effect on dyeability. Thus, as the $\sigma_{20}$ and spinning speed increase, the difference in dyeability between a draw-textured yarn and its as-spun feed yarn decreases, and this is advantageous, since it should be easier to control and avoid introducing dyeing defects when draw-texturing such yarns (of higher $\sigma_{20}$ and spinning speed). Thus filaments in Area C are preferred over those in Area B because of this dyeability phenomenon and similarly filaments in Areas D and E are, respectively, even more desirable, if economic considerations are ignored.

Generally, the use of a higher polymer temperature $T_p$ at these extremely high spinning speeds yields low skin-core filaments of dyeability inferior to that of similar filaments prepared at lower polymer temperatures, e.g. by use of high shear capillaries to obtain a high temperature difference ($\Delta T$) between the polymer at the wall and in the center of the capillary, although filaments of Example 28 (in Area E) showed surprisingly good dyeability despite the use of a high $T_p$, and so this effect seems to be more notable for filaments in Areas B, C and D, than in Area E, whose filaments were prepared at higher spinning speeds. A higher $T_p$ generally, however, provides as-spun filaments having improved tensile properties than as-spun filaments of similar low skin-core value prepared by a high shear capillary technique, provided the $T_p$ is not so excessive as to cause polymer degradation which causes broken filaments.

It is noted generally that the dyeability of filaments of lower denier per filament according to the invention is greater than that of otherwise similar filaments of higher denier per filament.

To lower skin-core value even further below line XYZ than is shown in FIG. 3 becomes increasingly expensive, and requires more extreme process conditions such as may introduce other problems of process control, which may become manifest in product quality, e.g. use of higher polymer temperatures may detract from the attractive dyeing characteristics of filaments having low skin-core values, and prepared using lower polymer temperatures, so it is generally preferred to prepare filaments of skin-core value such that $\Delta_{95\text{-}5} > 0.0014\sigma_{20}$ where about $1.6 < \sigma_{20} <$ about 3 gpd, i.e. above line ST in FIG. 3, and $\Delta_{95\text{-}5} > 0.0065\sigma_{20} - 0.0155$ where $\sigma_{20} >$ about 3 gpd, i.e. above line RS in FIG. 3, using present process techniques and under present economic conditions although these may change.

EXAMPLES 45–47

These Examples concern production of filaments of non-round cross-section following a procedure essentially similar to that of Example 17, except that for Examples 46 and 47 all 34 filaments were spun in a single bundle from a single spinneret. The conditions and yarn characteristics are given in Table V. In Example 45, the filaments have a trilobal cross-section, in Example 46, a scalloped oval cross-section and in Example 47, an octalobal cross-section.

To spin filaments of scalloped oval and of octalobal cross-section, a two-plate spinneret is used, as described in Gorrefa, U.S. Pat. No. 3,914,888 and McKay, U.S. Pat. No. 3,846,969, respectively. The top plate, referred to as a metering plate, is similar to that pictured in FIG. 2 with capillaries of dimensions D and L, whereas the bottom plate contains orifices of the appropriate design. Trilobal filaments are spun as described in Holland, U.S. Pat. No. 2,939,201 and to increase the pressure drop $\Delta P_s$ in the spinneret and the capillary shear as given by the $L/D^4$ ratio, the capillary dimensions are altered by inserting a meterplug in the counterbore of the spinneret and/or meterplate as described by Hawkins in U.S. Pat. No. 3,859,031.

EXAMPLES 48 and 49

A 90/10 percent by weight copolymer of ethylene terephthalate and 2,2-dimethyl propylene terephthalate of 26 HRV is spun into filaments having low skin-core values at 6000 yards/minute (Example 48) and 7000 yards/minute (Example 49) essentially as in Example 1. The conditions and yarn characteristics are shown in Table VI.

TABLE V

| Example | 45 | 46 | 47 |
|---|---|---|---|
| Spin. Speed, YPM | 7000 | 6000 | 6000 |
| Capillary (D×L), mils | 9 × 50 | 15 × 72 | 15 × 72 |
| $\frac{L}{D^4}$, $10^{-4}$ mils$^{-3}$ | 76.2 | 14.2 | 14.2 |
| Flow (w) pph/cap | .442 | .410 | .395 |
| $\frac{wL}{D^4}$, $10^{-4}$ pph mils$^{-3}$ | 33.68 | 5.82 | 5.61 |
| Block Temp. $T_B$ °C. | 315 | 305 | 308 |
| Pack Press. psig | 6000 | 6000 | 4600 |
| Poly. Temp. $T_p$ (°C.) | 314 | 307 | 308 |
| Air, scfm/pph | 5.6 | ~1.5 | ~1.5 |
| Finish Type | 3 | 3 | 2 |
| Denier | 160 | 171 | 167 |
| Init. Mod. gpd | 92.4 | 71.5 | 74.6 |
| $\sigma_{20}$, gpd | 2.89 | 2.03 | 2.24 |
| Tenacity, gpd | 3.73 | 3.63 | 3.88 |
| Elong. % | 34.2 | 49.3 | 49.6 |

TABLE V-continued

| Example | 45 | 46 | 47 |
|---|---|---|---|
| BOS, % | 2.5 | 3.2 | 2.9 |
| DHS, 160° C., % | 3.0 | 4.3 | 3.7 |
| Max. Sh. Tens. gpd | .132 | .124 | .115 |
| Density (ρ), g/cc | 1.3845 | 1.3771 | 1.3773 |
| $V_s$, km/sec | 3.12 | 2.86 | 2.86 |
| $T_{melt}$, °C. | 262 | 252 | 256 |
| π°, | 12.5 | 12 | 13 |
| CS, Å | 72 | 71 | 72 |
| LPS, Å | 320 | — | — |
| $\Delta_5$ | — | — | — |
| $\Delta_{95\text{-}5}$ | — | — | — |
| $\Delta_c$ | .205 | .205 | .204 |
| $\Delta_{am}$ | — | — | — |
| RDDR, % dye/min ½ | .063 | .064 | .048 |

TABLE VI

| Example | 48 | 49 |
|---|---|---|
| Spin. Speed, YPM | 6000 | 7000 |
| Orifice (D×L), mils | 10 × 20 | 10 × 20 |
| $\frac{L}{D^4}$, $10^{-4}$ mils$^{-3}$ | 20 | 20 |
| Flow (w) pph/cap | .398 | .430 |
| $\frac{wL}{D^4}$, $10^{-4}$ pph mils$^{-3}$ | 7.96 | 8.60 |
| Block Temp. $T_B$ °C. | 293 | 296 |
| Pack Press. psig | 5000 | 5600 |
| Poly. Temp. $T_p$ (°C.) | 295 | 298 |
| Air, scfm/pph | 3.0 | 2.0 |
| Finish Type | 2 | 2 |
| Denier | 168 | 156 |
| Init. Mod. gpd | 56.2 | 70.3 |
| $\sigma_{20}$, gpd | 1.62 | 2.28 |
| Tenacity, gpd | 3.21 | 3.51 |
| Elong. % | 58.1 | 49.8 |
| BOS, % | 10.8 | 6.6 |
| DHS, 160° C., % | 11.6 | 8.0 |
| Max. Sh. Tens. gpd | .139 | .167 |
| Density (ρ), g/cc | 1.3429 | 1.3512 |
| $V_s$, km/sec | 2.46 | 2.74 |
| $T_{melt}$, °C. | 230 | 227 |
| π°, | 12 | 13 |
| CS, Å | 68 | 64 |
| LPS, Å | 320 | — |
| $\Delta_5$ | .0750 | — |
| $\Delta_{95\text{-}5}$ | .0089 | — |
| $\Delta_c$ | — | — |
| $\Delta_{am}$ | — | — |
| RDDR, % dye/min ½ | .120 | — |

DRAW-TEXTURING EXAMPLES 50–63D

Some of the yarns of the foregoing Examples are used as feed yarns in a draw-texturing process on an ARCT 480 machine using a sapphire spindle under the conditions shown in Table VII to give draw-textured yarns having properties that are also shown in Table VII, for comparison with the properties of other draw-textured yarns shown in Table VIII, Examples 57D and 61D of which represent commercial yarns.

Both feed yarns for Examples 50 and 51 were prepared by spinning at 6000 yards/minute, but the as-spun yarn properties are different as can be seen from Examples 4 and 31 in Table I. Thus the feed yarn for Example 50 (Example 4) has better dyeability (RDDR of 0.073 v. 0.055) which is associated with a lower amorphous birefringence ($\Delta_{am}$ of 0.047 v. 0.061), while the feed yarn for Example 51 (Example 31) has better tensile properties as a flat (i.e. untextured) yarn. The RDDR values of the draw-textured yarns are reduced (to 0.060 for Example 50 v. 0.042 for Example 51) and are considered to be related inversely to the loss modulus peak temperature ($T_{E''max}$ of 109.3° v. 114.4°) of these textured yarns. Thus it will be noted that the dyeability of the draw-textured yarn of Example 50 is significantly superior to that of Example 51 and to those of the commercial yarns (57D and 61D) in Table VIII, and that this superior dyeability is accompanied by useful tensile properties and a satisfactory crimp level. This superior dyeability (Example 50 v. 51) is considered to result from the use of a slightly lower polymer temperature ($T_p$ of about 297° v. 301°) and the use of cross-flow air without any protective tube in Example 4 in contrast with the use of a protective tube of length 3⅞ inches and radial air-flow in Example 31. Thus, to obtain as-spun and textured yarns of better dyeability, it is preferred to use as low a polymer temperature as possible and to avoid delay in cooling the freshly-extruded filaments so far as is consistent with maintaining the skin-core value sufficiently low to avoid problems with broken filaments.

The feed yarns for Examples 52X, 53 and 54 were prepared by spinning at 7000 yards/minute, and again the RDDR values of the draw-textured yarns differ (0.057, 0.052 and 0.047, respectively) and can be related inversely to the respective loss modulus peak temperatures (110.7°, 112.7° and 113.3°) of the textured yarns and to the RDDR values (0.062, 0.059 and 0.054) and polymer temperatures ($T_p$) of the respective feed yarns (298°, 302° and 317°) and the use of a protective tube of length 3 inches and radial air-flow in Example 16 (53) in contrast to cross-flow air without any protective tube in Examples 20C and 44 (52X and 54 respectively), confirming the desirability of using a low polymer temperature ($T_p$) and/or avoiding delay in cooling the freshly-extruded filaments so as to obtain filaments of superior dyeability. The draw-textured yarn of Example 52X, however, had an excessive number of broken filaments, and would not be satisfactory commercially, despite its superior dyeability. It will be noted that the feed yarn for Example 52X (Example 20C) had a high skin-core value above line XYZ in FIG. 3. Thus, although in Example 20C continuity was achieved in spinning a yarn with superior dyeability, the yarn is not a suitable draw-texturing feed yarn because of the high skin-core value.

The feed yarn for Example 55 was prepared by spinning at 8000 yards/minute (Example 28) with a polymer temperature ($T_p$) of about 311° C. and cross-flow air without any protective tube. The feed yarn shows good dyeability (RDDR of 0.057, amorphous birefringence of 0.060) as does the draw-textured yarn (RDDR also of 0.057, $T_{E''max}$ of 111.3°), despite the use of a high polymer temperature ($T_p$), so the effect on dyeability of using high polymer temperatures may be less at these extremely high speeds, above 7000 yards/minute. It will be noted that the $T_{maxST}$ is slightly lower (at 257° C.) than is preferred when the feed yarns have been spun at lower speeds.

It will be noted that, as the spinning speed increases, from 6000 yards/minute, the difference between the RDDR values of the feed yarn and of the draw-textured yarn decreases and then disappears.

The feed yarn for Example 56 is the copolymer yarn of Example 48. The draw-textured yarn has very good dyeability (RDDR of 0.095), which correlates with its low $T_{E''max}$ of 102.6°, which is much lower than the value for the draw-textured homopolymer yarn of Example 50. Thus, the draw-textured copolymer filaments preferably have a $T_{E''max}$ less than about 107° C., and a $T_{maxSt}$ greater than about 215° C., which values are different from those preferred for homopolymer draw-textured yarns.

Table VIII shows the properties of various other draw-textured yarns for comparison with the yarn properties in Table VII, and the Examples in Table VIII are labelled with a "D" to show that they are draw-textured comparison yarns. The dyeability of the draw-textured yarns can be compared by referring to the RDDR values at the bottom of Tables VII and VIII, and also to the K/S values of some of these yarns shown in Tables IX and X, whereas the K/S values of some feed yarns are compared in Table XI, in which the feed yarns of Table VIII are referred to with a "F".

Example 57D is prepared from 57F, a commercially-available partially oriented feed yarn prepared by spinning at 3500 yards/minute, as described by Piazza & Reese in U.S. Pat. No. 3,772,872. The feed yarn for Examples 59D and 60D is 59F and is prepared by a similar process, except that the spinning speed is 5000 yards/minute, and the feed yarn for Example 58D is similar except that radial air-flow is used to cool the freshly-extruded filaments. Example 61D is prepared from 61F, a commercially-available flat yarn used also as a texturing feed yarn, prepared by coupled spin-drawing, i.e. spinning at about 1000 yards/minute and drawing 3.5× before winding up as a fully drawn yarn. Example 62D is prepared from 62F, which is prepared by drawing 59F 1.2× on a commercially-available draw-winder. The feed yarn for Example 63D is prepared from a spin-drawn yarn, similar to 61F, by relaxing about 20% and then redrawing by a similar amount in separate (split) steps.

It will be noted that the RDDR values of the only two commercial samples (57D and 61D) are less than 0.045, and thus inferior to the preferred draw-textured yarns of the invention prepared with a low polymer temperature ($T_p$). If, however, as-spun yarns of the invention are draw-textured using higher draw-texturing tensions than are used on the pin-texturing machines in the Examples, e.g. 50–70 grams, such as are customary with high speed friction-twist draw-texturing machines, the dyeability of the draw-textured yarns is reduced, as occurs when draw-friction-twisting commercial prior art feed yarn that has been spun at about 3500 ypm, and the difference in dyeability over such prior art draw-textured yarns is not so large.

If, however, as-spun yarns of the invention are draw-textured using higher draw-texturing tensions than are used on the pin-texturing machines in the Examples, e.g. 50–70 grams, such as are customary with high speed friction-twist draw-texturing machines, the dyeability of the draw-textured yarns is reduced, as occurs when draw-friction-twisting commercial prior art feed yarn that has been spun at about 3500 ypm, and the difference in dyeability over such prior art draw-textured yarns is not so large.

The apparent dye depths (K/S values) of some of the yarns in the Examples are shown also in Table IX after dyeing with a 40 to 1 dye bath to fiber ratio, using two levels of the disperse dyestuff with and without a carrier (Liquid JET JT, a biphenyl base) under atmospheric pressure; it will be noted that the K/S values are similar when a carrier is used, but that a significant advantage is shown without carrier for the yarn of Example 50.

Tables X and XI show the results of competitive dyeing (i.e. in the same dye bath) various draw-textured yarns and feed yarns, respectively. As shown by the RDDR values in Tables VII and VIII and the K/S values in Table IX (comparative) and in Table X (competitive), the draw-textured yarns of the invention have dyeability superior to that of commercially-available draw-textured yarns.

It will be noted also from Tables VII and VIII that the high $T_{maxST}$ (at least 258° C.) and low $T_{E''max}$ (115° C. or less) distinguishes the textured yarns of the invention from the comparative samples. Although Example 63D shows good dyeability, the textured yarns are not sufficiently bulky (low $CCA_5$).

TABLE VII

| Example | 50 | 51 | 52X | 53 | 54 | 55 | 56 |
|---|---|---|---|---|---|---|---|
| Spin. Speed, ypm | 6000 | 6000 | 7000 | 7000 | 7000 | 8000 | 6000 |
| Yarn type | x-flow | radial | x-flow | radial | x-flow | x-flow | copoly. |
| Feed Yarn (Ex.) | 4 | 31 | 20C | 16 | 44 | 28 | 48 |
| Draw Ratio | 1.08 | 1.10 | 1.04 | 1.04 | 1.02 | 1.04 | 1.12 |
| Spindle (Mrpm) | 389.6 | 389.6 | 389.6 | 389.6 | 389.6 | 389.6 | 389.6 |
| Twist (TPI) | 60S | 66S | 60S | 60S | 60S | 60S | 60S |
| Take-up (mpm) | 164 | 164 | 164 | 164 | 164 | 164 | 164 |
| Prespind.Tens.,gms | 19 | 19 | 23 | 19 | 22 | 31 | 33 |
| Postspind.Tens., gms | 49 | 48 | 56 | 43 | 40 | 80 | 74 |
| 1st Htr.Temp., °C. | 210 | 225 | 210 | 210 | 210 | 210 | 210 |
| 2nd Htr.Temp., °C. | 225 | 235 | 225 | 225 | 225 | 225 | 225 |
| 2nd Htr.OvrFd % | +12 | +12 | +12 | +12 | +12 | +12 | +12 |
| Denier | 188 | 160 | 173 | 163 | 168 | 166 | 160 |
| Init.Mod.,gpd | 34.3 | 15.9 | 28.9 | 42.4 | 29.2 | 35.0 | 33.8 |
| Tenacity, gpd | 3.59 | 3.41 | 3.46 | 3.44 | 3.66 | 3.48 | 2.72 |
| Elong., % | 40.1 | 30.6 | 32.5 | 29.8 | 32.9 | 21.5 | 26.9 |
| BOS, % | 3.0 | 0.2 | 1.3 | 1.2 | 0.4 | 1.1 | 1.8 |
| $CCA_5$, 5mg/d(%) | 6.3 | 7.8 | 6.2 | 5.2 | 4.3 | 5.2 | 1.6 |
| $T_{max\ ST}$, °C. | 258 | 258 | 259 | 262 | 262 | 257 | 220 |
| $T_{E''max}$, °C. | 109.3 | 114.4 | 110.7 | 112.7 | 113.3 | 111.3 | 102.6 |
| RDDR,% dye/min$^{\frac{1}{2}}$ | .060 | .042 | .057 | .052 | .047 | .057 | .095 |

TABLE VIII

| Example | 57D | 58D | 59D | 60D | 61D | 62D | 63D |
|---|---|---|---|---|---|---|---|
| Spin. Speed, ypm | 3500 | 5000 | 5000 | 5000 | 1000 | 5000 | Draw-Relax |
| Yarn type | x-flow | radial | x-flow | x-flow | 3.5X draw | 1.2X draw | Redraw |
| Draw Ratio | 1.50 | 1.20 | 1.20 | 1.20 | 1.01 | 1.04 | 1.04 |
| Spindle (Mrpm) | 389.6 | 389.6 | 389.6 | 389.6 | 389.6 | 389.6 | 389.6 |
| Twist (TPI) | 60S | 66S | 60S | 60S | 60S | 60S | 60S |
| Take-up (mpm) | 164 | 149 | 164 | 164 | 164 | 164 | 164 |
| Prespind. Tens., gms | 18 | 25 | 25 | 27 | 10 | 22 | 15 |
| Postspind. Tens., gms | 36 | 45 | 53 | 53 | 29 | 60 | 41 |
| 1st Htr. Temp., °C. | 210 | 225 | 210 | 210 | 210 | 210 | 210 |
| 2nd Htr. Temp., °C. | 225 | 235 | 225 | 235 | 225 | 225 | 225 |
| 2nd Htr. OvrFd, % | +12 | +20 | +12 | +12 | +12 | +12 | +12 |
| Denier | 162 | 164 | 169 | 167 | 162 | 157 | 188 |
| Init. Mod., gpd | 21.7 | 17.3 | 26.2 | 37.6 | 21.4 | 33.4 | 41.8 |
| Tenacity, gpd | 3.47 | 3.57 | 3.65 | 3.48 | 3.87 | 3.49 | 2.80 |
| Elong. % | 33.3 | 27.6 | 38.2 | 33.4 | 26.7 | 32.9 | 29.5 |
| BOS, % | 0.8 | 1.4 | 1.6 | 1.2 | 0.4 | 0.9 | 2.1 |
| $CCA_5$, 5mg/d, (%) | 6.2 | 7.8 | 6.2 | 5.9 | 5.0 | 5.2 | 1.8 |
| Max. Sh. Tens., gpd | .035 | .032 | .033 | .034 | .025 | .023 | .037 |
| $T_{max\ ST}$, °C. | 250 | 254 | 252 | 253 | 246 | 255 | 200 |
| $T_{E''max}$, °C. | 117.9 | 120.4 | 115.3 | 113.6 | 131.2 | 114.1 | 118.7 |
| RDDR, % dye/min$^{\frac{1}{2}}$ | .041 | .033 | .046 | .049 | .026 | .048 | .053 |

TABLE IX

Comparative Dyeability of Lawson Knit Socks
Draw Set-Textured Yarns at 212° F. For 2 Hours

| Feed Yarn Type (Speed in min.) | 2% Owf C.I. Disperse Red 55 No Carrier K/S | 2% Owf C.I. Disperse Red 55 20% Owf Carrier K/S | 4% Owf C.I. Disperse Red 55 No Carrier K/S | 4% Owf C.I. Disperse Red 55 20% Owf Carrier K/S |
|---|---|---|---|---|
| DRAWN Ex. 61D | 6.80 | 10.36 | 8.68 | 21.95 |
| POY Ex. 57D | 9.17 | 10.95 | 13.30 | 20.29 |
| 6000 Ex. 50 | 12.64 | 11.19 | 21.43 | 21.14 |

TABLE X

COMPETITIVE DYE-AT-THE-BOIL OF VARIOUS DRAW SET-TEXTURED YARNS

| TEXTURED YARN TYPE (speed in ypm) | (2% owf Disperse Blue 27) TEXTURED YARN DESIGNATION | K/S-VALUES |
|---|---|---|
| Draw-Relax-Redraw 1000 ypm | 63D | 9.15 |
| 3.5X Draw 5000 ypm | 61D | 2.35 |
| 1.2X Draw 3500 ypm | 62D | 7.14 |
| Cross flow 5000 ypm | 57D | 5.21 |
| Cross flow 6000 ypm | 59D | 6.93 |
| Cross flow 6000 ypm | 50 | 10.18 |
| Copolymer 7000 ypm | 56 | 23.76 |
| Radial 7000 ypm | 53 | 7.59 |
| Cross flow 7000 ypm | 52X | 11.49 |
| Cross flow 8000 ypm | 54 | 8.86 |

TABLE X-continued

| COMPETITIVE DYE-AT-THE-BOIL OF VARIOUS DRAW SET-TEXTURED YARNS (2% owf Disperse Blue 27) | | |
|---|---|---|
| TEXTURED YARN TYPE | TEXTURED YARN DESIGNATION | K/S-VALUES |
| Cross flow | 55 | 11.22 |

TABLE XI

| COMPETITIVE DYE-AT-THE BOIL OF VARIOUS POLYESTER FEED YARNS (2% owf Disperse Blue 27) | | |
|---|---|---|
| FEED YARN TYPE | FEED YARN DESIGNATION | K/S-VALUES |
| (speed in ypm) | | |
| ~1000 ypm | | |
| 3.5X Draw 5000 ypm | 61F | 2.50 |
| 1.2X Draw 3500 ypm | 62F | 4.85 |
| Cross flow 5000 ypm | 57F | 14.50 |
| Cross flow 6000 ypm | 59F | 9.75 |
| Cross flow 6000 ypm | 4 | 9.71 |
| Copolymer 7000 ypm | 48 | 16.56 |
| Cross flow 7000 ypm | 19 | 8.31 |
| Radial 7000 ypm | 16 | 7.31 |
| Cross flow 7000 ypm | 36 | 6.96 |
| Cross flow 8000 ypm | 37 | 8.81 |
| Cross flow | 28 | 8.45 |

EXAMPLES 64–71P (Table XII) STAPLE FIBERS

Examples 65 to 70 relate to 1.5 inch (38 mm) staple fibers that were prepared with different treatment conditions (indicated in the headings of Table XII) from the same feed yarn (similar to the as-spun yarn of Example 12). All the feed yarns were cut with a knife; some measurements, however, were made on the uncut filaments, rather than on the staple fibers, for convenience. The feed yarns of Examples 67 and 70 were drawn, using a draw ratio of about 1.37×, at about 100 feet min, using feed and draw baths at temperatures, respectively, of 75° and 95° C. The feed yarns of Examples 65, 66, 68 and 70 were steam-crimped in a stuffer box with steam at 4 psig. The feed yarns of Examples 66, 69 and 70 were relaxed in an oven at 135° for about 6 minutes. The properties of these staple fibers are compared in the Table with those of the feed yarn (Example 64) and with those of a commercial control staple yarn (Example 71C).

Both undrawn and drawn staple fibers of this invention have adequate tensiles, ($\sigma_{07}$ is stress at 7% extension), work recovery properties ($W_x$) and crimp properties (cpi), and significantly better RDDR and significantly higher single filament flex resistance than the control (71P), which are important improvements. The fact that staple fibers of the invention have the indicated properties equivalent to and better than those of commercially-available staple, even without drawing and without relaxing after crimping such new filaments, is a significant economic advantage since such steps may be omitted. Furthermore, a tow of filaments of the invention may be converted into staple by stretch-breaking without prior drawing, if desired.

TABLE XII

| Example | As-Spun Feed Yarn 64 | Undrawn Crimped Unrelaxed 65 | Undrawn Crimped Relaxed 66 | Drawn Uncrimped Unrelaxed 67 | Drawn Crimped Unrelaxed 68 | Drawn Uncrimped Relaxed 69 | Drawn Crimped Relaxed 70 | Commercially Available Staple Yarn 71P |
|---|---|---|---|---|---|---|---|---|
| DPF | 5.3 | 5.3 | 5.1 | 3.8 | 4.2 | 3.8 | 4.3 | 3.3 |
| Init. Mod., gpd | 83.6 | 48.1 | 65.0 | 137.0 | 40.0 | 68.8 | 53.3 | 49.8 |
| $\sigma_{07}$, gpd | 1.46 | 1.11 | 1.47 | 4.58 | 1.07 | 2.08 | 1.27 | 0.96 |
| Elong., % | 49.4 | 48.4 | 43.5 | 16.5 | 21.6 | 28.6 | 23.0 | 29.3 |
| Tenacity, gpd | 3.67 | 3.38 | 3.65 | 5.11 | 4.31 | 5.25 | 4.12 | 4.52 |
| BOS, % | 1.9 | ~0.0 | 0.3 | 7.1 | 0.8 | 6.5 | 0.4 | 1.0 |
| Max. Sh. Tens., gpd | 0.108 | 0.024 | 0.028 | 0.424 | 0.022 | 0.381 | 0.026 | 0.017 |
| $W_{1\%}$, % | 57.5 | 71.4 | 81.8 | 85.7 | 63.6 | 89.6 | 77.8 | 73.8 |
| $W_{3\%}$, % | 37.7 | 39.1 | 39.8 | 47.6 | 34.8 | 48.4 | 48.3 | 57.8 |
| $W_{5\%}$, % | 26.8 | 25.4 | 30.7 | 61.6 | 20.3 | 58.0 | 26.2 | 32.7 |
| Flex Resist. | 16,479 | 15,033 | 15,186 | 15,131 | 14,440 | 6,941 | 25,997 | 4,815 |
| Density($\rho$), g/cc | 1.3884 | 1.3910 | 1.3955 | 1.3848 | 1.3918 | 1.3853 | 1.3961 | 1.3837 |
| CS A | 75 | 59 | 69 | 68 | 72 | 75 | 59 | 45 |
| RDDR, % dye/min ½ | .067 | .074 | .058 | .049 | .050 | .044 | .038 | .025 |
| CPI | — | 13.4 | 7.4 | — | 16.8 | — | 14.1 | 9.7 |

EXAMPLES 72C–83 (TABLE XIII)

The torsional moduli G and Poisson's ratios $\nu$ of various yarns are compared in Table XIII. The yarns of Examples 74C, 75, 76 and 77C are as-spun yarns as prepared in Examples 10C, 5, 18 and 29C, respectively. The yarns of Examples 72P, 73P and 78P are similar to the feed yarns 57F, 59F and 61F, respectively, discussed in relation to Tables VIII and XI. The yarn of Example 79P is similar to the draw-set-textured yarn of Example 57D.

It is noted that the torsional modulus G generally increases with spinning speed, i.e. with increasing uniaxial molecular orientation, given here by the sonic modulus $E_S$, provided the skin-core value is low. Thus, although the sonic modulus $E_S$ for Example 74C is less than that for Example 75, the torsional modulus is significantly higher, and the skin-core value is larger. The sensitivity of the torsional modulus G to skin-core value is also represented by a decrease in the Poisson's ratio $\nu$ for a given level of sonic modulus. Thus, the feed yarns of this invention, being characterized by low skin-core values, have correspondingly lower torsional moduli G and larger Poisson's ratios $\nu$ than yarns having higher skin-core values and having similar sonic moduli $E_S$.

TABLE XIII

| Ex. | Spin Speed (YPM) mils | Spinneret (D × L), (°C.) | Polymer Temp. $T_p$ Denier | Filament dynes/cm | Tors.Mod., $G \times 10^{-10}$ dynes/cm$^2$ | Sonic Mod., $E_s \times 10^{-10}$ ($\nu$) | Poisson's Ratio ($\Delta_{.95-.05}$ | Skin-Core |
|---|---|---|---|---|---|---|---|---|
| | | | TORSIONAL PROPERTIES | | | | | |
| 72P | 3500 | 15 × 60 | [296] | ~7.0 | 0.55 | [4.10] | 2.73 | — |
| 73P | 5000 | 10 × 20 | 303 | 5.2 | 1.23 | 8.51 | 2.46 | — |
| 74C | 6000 | 15 × 60 | (296) | 5.1 | 1.54 | 11.29 | 2.67 | .0085 |
| 75 | 6000 | 10 × 40 | (299) | 5.0 | 1.33 | 11.66 | 3.38 | .0066 |
| 76 | 7000 | 10 × 20 | (312) | 4.7 | 1.42 | 13.76 | 3.85 | .0084 |
| 77C | 8000 | 10 × 20 | (316) | 4.7 | 1.50 | 17.03 | 4.68 | .0139 |
| 78P | Drawn | 15 × 60 | ~(292) | ~4.7 | 1.33 | [14.1] | 4.30 | — |
| 79P | DTY | 15 × 60 | [296] | 4.9 | 0.75 | — | — | — |

( ) = calculated value
[ ] = typical values for class of yarns; not measured here for specific sample.

Many variations are possible. For instance, in Examples 48 and 49, a 90.10 by weight copolymer of 90% ethylene terephthalate and 10% 2,2-dimethyl propylene terephthalate of 26 HRV has been spun to give polyester yarns whose properties are essentially similar in many respects to those for the homopolymer but the boil-off and dry heat shrinkages are higher for the copolymer. This difference in properties, resulting from spinning polymers of different chemical composition at the same speed, makes possible the production of multifilament yarns having filaments of differing (2 or more different) properties in the same yarn bundle. Thus, the following variations are possible, for example:

A. A low shrinkage post-bulkable mixed shrinkage cospun yarn obtained by cospinning homopolymer filaments and copolymer filaments as described immediately above; hard yarns result from spinning at, e.g. 6300 meters/minute, or drawable yarns from spinning at suitable lower speeds.

B. Heather yarns made directly by selecting one or more components in A to have a different inherent coloration, as described in Reese U.S. Pat. No. 3,593,513, without the need for the drawing step described therein.

C. Control of quench conditions, e.g. asymmetrical passage of hot air below the spinneret, to lead to a differential shrinkage and crimp potential.

D. Spun-like multifilament yarns obtained by breaking only some of the filaments. Selection, e.g. of capillary dimensions, some being inside the preferred limits, while others are of e.g. larger diameter and/or lower $L/D^4$ ratio, would give multifilament yarns, some filaments of which would have higher skin-core and tend to break, especially during texturing. The pill resistance of the broken filaments would be expected to be greater because of their lower strength.

E. Jet screen bulking, if desired in combination or instead of other types of texturing.

F. Bicomponent filaments from differing viscosity levels.

G. Fiberfill products.

We claim:

1. In a process for melt-spinning ethylene terephthalate polyester and cooling in the atmosphere to solidify as filaments with a low differential birefringence between the surface and the core of such filaments, the improvement, when withdrawing the filaments at a speed (V in yards/minute) of at least about 5500 yards/minute, wherein the polymer temperature ($T_p$), measured (in °C.) in the filter pack at a point 50–100 mils above the center of the spinneret plate, is maintained above a minimum value depending on an exponential of the speed V and a function of the length (L) and diameter (D) (in mils) of the spinneret capillary and the throughput (w) (in pounds per hour) per capillary according to the relationship:

$$T_p \geqq 284.5\left[\exp\left(\frac{V}{85{,}000}\right)\right] - 660\left(\frac{Lw}{D^4}\right)^{0.685}$$

2. A process according to claim 1, wherein the speed (V) is at least about 7000 yards/minute.

3. A process according to claim 1, wherein the capillary diameter (D) is from 9 to 15 mils, and the length (L) is such that $L/D^4$ is from $20\times10^{-4}$ mils$^{-3}$ to $100\times10^{-4}$ mils$^{-3}$.

4. A process according to claim 1, wherein $Lw/D^4$ is $9\times10^{-4}$ pph mils$^{-3}$ to $45\times10^{-4}$ pph mils$^{-3}$.

5. A process according to claim 1, wherein filaments of denier per filament 4 to 7 are produced, and the emerging filaments are subjected to a flow of air at a rate of less than 4 standard cubic feet/minute per pound of polymer per hour of total throughput.

6. A process according to claim 1, wherein filaments of less than 4 denier per filament are produced, and the emerging filaments are subjected to a flow of air at a rate of less than 6 standard cubic feet/minute per pound of polymer per hour of total throughput.

7. A process according to claim 1, wherein the polymer temperature ($T_p$) is about 295° to about 305° C.

8. In a process for melt spinning poly(ethylene terephthalate) and cooling in the atmosphere to solidify as filaments of denier less than 7 denier per filament with a low differential birefringence between the surface and the core of such filaments, the improvement, when withdrawing the filaments at a speed of about 5500 to about 8000 yards/minute, wherein the polymer temperature, measured at a point 50–100 mils above the center of the spinneret plate, is about 295° to about 305° C., and wherein $Lw/D^4$ is $9\times10^{-4}$ to $45\times10^{-4}$ pph mils$^{-3}$, where w is the throughput in pounds per hour per capillary, and L and D are the length and diameter of the capillary in mils, and D is from 9 to 15 mils, and the filaments are subjected to a flow of air at a rate of less than 6 standard cubic feet/minute per pound of polymer per hour of total throughput, provided that the rate is less than 4 standard cubic feet/minute per pound of polymer per hour of total throughput for filaments of 4 to 7 denier per filament.

9. In a process for melt-spinning a continuous multifilament strand of polyester filaments of denier about 4 to 7 denier per filament, and withdrawing such filaments at a speed of at least 4700 meters/minute, the improvement comprising using a spinneret with an orifice capillary of diameter (D) from 9 to 15 mils, and a length (L) in mils such that $L/D^4$ is from $20\times10^{-4}$ to $70\times10^{-4}$ $mils^{-3}$.

10. A process according to claim 9, wherein the diameter (D) is from 9 to 11 mils.

11. A process according to claim 9, wherein the temperature of the polymer at the wall of the orifice is at least 5° C. higher than the average temperature of the polymer at the orifice.

12. A process according to claim 9, wherein the filaments are withdrawn at a speed of at least about 6000 meters/minute.

13. A process according to claim 9, wherein the spinneret face and the emerging filaments are protected from turbulent eddies by a hollow tube which surrounds the emerging filaments.

14. A process according to claim 9, wherein a gas is introduced radially around the filament strand.

15. A process according to claim 14, wherein the gas is introduced through a foraminous tube with an outer plenum chamber.

16. A process according to claim 14, wherein the amount of gas is less than 4 standard cubic feet per minute per pound of polymer throughput per hour.

17. In a draw-texturing process, the improvement comprising using as feed yarn a yarn comprising poly(ethylene terephthalate) filaments of enhanced dyeability and low shrinkage, characterized by a long-period spacing of more than 300 Å and by a differential birefringence ($\Delta_{95-5}$) between the surface and the core of the filament of less than about $0.0055+0.0014\sigma_{20}$, where $\sigma_{20}$ is the stress measured at 20% extension, and is at least about 1.6 gpd.

18. In a draw-texturing process, the improvement comprising using as feed yarn a yarn comprising poly(ethylene terephthalate) filaments of enhanced dyeability and low shrinkage, characterized by a long-period spacing of more than 300 Å and by a differential birefringence ($\Delta_{95-5}$) between the surface and the core of the filament of less than $0.0065\sigma_{20}$-0.0100, where $\sigma_{20}$ is the stress measured at 20% extension, and is from about 3 to about 4 gpd.

19. In a draw-texturing process, the improvement comprising using as feed yarn a yarn comprising poly(ethylene terephthalate) filaments of enhanced dyeability and low shrinkage, characterized by a long-period spacing of more than 300 Å and by a differential birefringence ($\Delta_{95-5}$), between the surface and the core of the filament, that is less than about $0.0055+0.0014\sigma_{20}$, where $\sigma_{20}$ is the stress measured at 20% extension, when $\sigma_{20}$ is about 1.6 gpd to about 3 gpd, and by a differential birefringence ($\Delta_{95-5}$) that is less than about $0.0065\sigma_{20}$-0.0100, when $\sigma_{20}$ is about 3 to about 4 gpd.

20. In a draw-texturing process, the improvement comprising using as feed yarn a yarn comprising poly(ethylene terephthalate) filaments of enhanced dyeability and low shrinkage, characterized by a long-period spacing of more than 300 Å and by a differential birefringence ($\Delta_{95-5}$) between the surface and the core of the filament of less than about 0.008, and by a stress measured at 20% extension ($\sigma_{20}$) of at least about 1.6 gpd.

21. In a draw-texturing process, the improvement comprising using as feed yarn a yarn comprising poly(ethylene terephthalate) filaments of enhanced dyeability and low shrinkage, characterized by a differential birefringence ($\Delta_{95-5}$), between the surface and the core of the filament, that is less than $0.0055+0.0014\sigma_{20}$, where $\sigma_{20}$ is the stress measured at 20% extension, when $\sigma_{20}$ is about 1.6 to about 3 gpd, and that is less than $0.0065\sigma_{20}$-0.0100, when $\sigma_{20}$ is about 3 to about 4 gpd, by a crystal size of at least 55 Å, being at least (1250ρ-1670) Å, where ρ is the density of the polymer in $g/cm^3$, and by an amorphous birefringence of less than 0.07.

22. In a process for preparing staple fiber, the improvement comprising using as the feed poly(ethylene terephthalate) filaments of enhanced dyeability and low shrinkage, characterized by a long-period spacing of more than 300 Å and by a differential birefringence ($\Delta_{95-5}$) between the surface and the core of the filament of less than about $0.0055+0.0014\sigma_{20}$, where $\sigma_{20}$ is the stress measured at 20% extension, and is at least about 1.6 gpd.

23. In a process for preparing staple fiber, the improvement comprising using as the feed poly(ethylene terephthalate) filaments of enhanced dyeability and low shrinkage, characterized by a long-period spacing of more than 300 Å and by a differential direfringence ($\Delta_{95-5}$) between the surface and the core of the filament of less than $0.0065\sigma_{20}$-0.0100, where $\sigma_{20}$ is the stress measured at 20% extension, and is from about 3 to about 4 gpd.

24. In a process for preparing staple fiber, the improvement comprising using as the feed poly(ethylene terephthalate) filaments of enhanced dyeability and low shrinkage, characterized by a long-period spacing of more than 300 Å and by a differential birefringence ($\Delta_{95-5}$), between the surface and the core of the filament, that is less than about $0.0055+0.0014\sigma_{20}$, where $\sigma_{20}$ is the stress measured at 20% extension, when $\sigma_{20}$ is about 1.6 gpd to about 3 gpd, and by a differential birefringence ($\Delta_{95-5}$) that is less than about $0.0065\sigma_{20}$-0.0100, when $\sigma_{20}$ is about 3 to about 4 gpd.

25. In a process for preparing staple fiber, the improvement comprising using as the feed poly(ethylene terephthalate) filaments of enhanced dyeability and low shrinkage, characterized by a long-period spacing of more than 300 Å and by a differential birefringence ($\Delta_{95-5}$) between the surface and the core of the filament of less than about 0.008, and by a stress measured at 20% extension ($\sigma_{20}$) of at least about 1.6 gpd.

26. In a process for preparing staple fiber, the improvement comprising using as the feed poly(ethylene terephthalate) filaments of enhanced dyeability and low shrinkage, characterized by a differential birefringence ($\Delta_{95-5}$), between the surface and the core of the filament, that is less than $0.0055+0.0014\sigma_{20}$, where $\sigma_{20}$ is the stress measured at 20% extension, when $\sigma_{20}$ is about 1.6 to about 3 gpd, and that is less than $0.0065\sigma_{20}$-0.0100, when $\sigma_{20}$ is about 3 to about 4 gpd, by a crystal size of at least 55 Å, being at least (1250ρ-1670) Å, where ρ is the density of the polymer in $g/cm^3$, and by an amorphous birefringence of less than 0.07.

* * * * *